US005771799A

United States Patent [19]

Makino

[11] Patent Number: 5,771,799

[45] Date of Patent: Jun. 30, 1998

[54] INK ROLLER DEVICE AND NUMBERING MACHINE EQUIPPED WITH THE INK ROLLER DEVICE

[76] Inventor: Kazunosuke Makino, 9-8-406, Yonban-Cho, Chiyoda-Ku, Tokyo, Japan

[21] Appl. No.: 644,066

[22] Filed: May 9, 1996

[30] Foreign Application Priority Data

Jun. 8, 1995 [JP] Japan ..... 7-142148

[51] Int. Cl.[6] ..... B41J 1/26; B41J 7/34; B41J 27/12

[52] U.S. Cl. ..... 101/108; 101/104; 101/329; 101/348

[58] Field of Search ..... 101/329, 327, 101/103, 104, 108, 348

[56] References Cited

U.S. PATENT DOCUMENTS

| | | | |
|---|---|---|---|
| 4,044,677 | 8/1977 | Hamisch, Jr. | 101/348 |
| 4,119,033 | 10/1978 | Sato | 101/348 |
| 4,216,715 | 8/1980 | Sato | 101/103 |
| 4,252,060 | 2/1981 | Strausburg | 101/348 |
| 4,273,046 | 6/1981 | Sato | 101/348 |
| 4,274,034 | 6/1981 | Becker | 101/288 |
| 4,323,011 | 4/1982 | Hamilton | 101/327 |
| 4,433,624 | 2/1984 | Mistyurik | 101/348 |
| 5,303,648 | 4/1994 | Shih | 101/329 |

FOREIGN PATENT DOCUMENTS

| | | | |
|---|---|---|---|
| 456631 | 11/1991 | European Pat. Off. . | |
| 1 020 648 | 12/1955 | Germany . | |
| 1020648 | 12/1957 | Germany | 101/327 |
| 24775 | 2/1983 | Germany . | |
| 39 153 | 9/1983 | Germany . | |
| 22 65 759 | 12/1984 | Germany . | |
| 124690 | 9/1980 | Japan | 101/103 |
| 322264 | 12/1929 | United Kingdom . | |
| 398754 | 9/1933 | United Kingdom . | |
| 1029889 | 5/1966 | United Kingdom . | |

*Primary Examiner*—Edgar S. Burr
*Assistant Examiner*—Daniel J. Colilla
*Attorney, Agent, or Firm*—Oblon, Spivak, McClelland, Maier & Neustadt, P.C.

[57] ABSTRACT

An ink roller device which permits easy and smooth removal and installation of an ink roller without soiling hands and which also ensures a prolonged service life of the ink roller, and a numbering machine which is equipped with the ink roller device. The numbering machine is equipped with a numbering main body comprised of a frame, a character wheel unit which is incorporated in the main body so that it is allowed to move up and down between a printing position and a home position thereof, an operating means equipped with an operating knob which enables the character wheel unit to be depressed against the spring force of a resetting spring, a swinging arm mechanism which is provided on the numbering main body and which can be swung as the operating knob is depressed, and a cassette-type ink roller device which is detachably held at the bottom of the swinging arm mechanism. The ink roller device has an ink roller which is detachably mounted on a roller holding frame; the ink roller rolls to contact the printing surfaces of the printing elements constructing the character wheel unit so as to apply ink to the printing surfaces.

8 Claims, 20 Drawing Sheets

INK ROLLER DEVICE AND NUMBERING MACHINE EQUIPPED WITH THE INK ROLLER DEVICE

BACKGROUND OF THE INVENTION

1. Field of the Invention

The present invention relates to a cassette-type ink roller device used as an inker for a numbering machine and a numbering machine equipped with the ink roller device.

2. Prior Art

A numbering machine is in extensive use as an inker for printing numbers of a plurality of digits on printed forms of office documents. A typical conventional numbering machine has a character wheel unit which incorporates a plurality of digits of diecast character wheels and which is installed in the numbering main body constituted by a frame in such a manner that the character wheel unit is allowed to move up and down therein. The printing elements of the character wheels of the respective digits are inked with an ink pad which is interlocked with the vertical movement of the character wheel unit (refer to Japanese Patent Laid-Open Publication No. SHO 53-100017 and Japanese Utility Model Publication No. SHO 60-17355).

Supplying ink to the printing elements of the character wheels of the respective digits constituting the character wheel unit, however, restricts the area of a printing element which contacts the ink pad, preventing the effective use of the whole surface of the pad. As a result, only a particular portion, i.e. the central portion, of the ink pad which contacts the printing elements is repeatedly used, leading to a short service life of the ink pad or gradual depression of the contacting portion of the ink pad. This is likely to cause uneven application of the ink to the printing surfaces of the printing elements, which in turn results in variations in the density of ink or blurred or illegible printing attributable to the uneven inking.

Some numbering machines are equipped with ink roller devices which are interlocked with the vertical motion of the character wheel units which are provided in the numbering main bodies comprised of frames as disclosed in Japanese Utility Model Publication No. SHO 55-96758 and Japanese Utility Model Publication No. SHO 61-112965.

In a conventional ink roller device, an ink roller is directly fixed on a free end of a swinging arm which is supported on the top of the numbering main body so that the ink roller swings around the supporting shaft of the swinging arm.

When the operating knob of the numbering machine is depressed, the character wheels of the respective digits of the character wheel unit come in contact with the ink roller to push in the ink roller, thereby rotating the ink roller around the supporting shaft of the swinging arm.

The conventional numbering machine equipped with the ink roller device is designed so that the character wheels of the respective digits of the character wheel unit directly push the ink roller to rotate it around the supporting shaft of the swinging arm. This design is disadvantageous in that the rotation of the ink roller tends to be not smooth and the pressing force applied by the character wheels tends to be larger at the initial stage of the rotation of the ink roller. Besides, the pressing force applied by the character wheels of the respective digits is not uniform during the rotation of the ink roller. This unavoidably leads to the uneven application of ink to the printing elements of the character wheels of the respective digits and the resulting variations in inking, making it difficult to achieve sharp printing with possible illegible printed characters.

Further, in the conventional numbering machine, the ink roller of the ink roller device is provided on the free end of the swinging arm and it comes in direct contact with the respective character wheels of the character wheel unit to be pushed and rolled. No structure has been disclosed for assuring even and uniform application of ink to the printing elements of the respective character wheels constructing the character wheel unit.

Moreover, in the conventional numbering machine, the ink roller is directly installed on the free end of the swinging arm and the ink roller device is not detachable. This makes it difficult to attach or detach the ink roller smoothly and quickly when the ink roller is replaced.

In some conventional ink roller devices, the ink rollers are detachably installed on the free ends of the swinging arms. However, it is difficult to detach the swinging arms themselves. Therefore, it is difficult to attach or detach the ink rollers to or from the swinging arms when replacing the ink rollers, and the ink rollers do not permit easy and quick replacement without soiling the hands of a person replacing them.

SUMMARY OF THE INVENTION

The present invention has been accomplished for solving the problems described above, and it is an object of the present invention to provide an ink roller device and a numbering machine equipped with the ink roller device which permit easy and smooth replacement of the ink roller without soiling the hands and which prolong the service life of the ink roller.

Another object of the present invention is to provide an ink roller device and a numbering machine equipped with the ink roller device which make it possible to uniformly apply ink to the printing elements of the character wheels of the respective digits constituting a character wheel unit so as to ensure sharp printing.

Still another object of the present invention is to provide a numbering machine which employs a cassette-type ink roller device to make the ink roller device itself detachable, the ink roller being also made detachable from the ink roller device, thereby permitting smooth and easy replacement of the ink roller.

A further object of the present invention is to provide a numbering machine which permits easy and smooth adjustment of the character wheels of the respective digits constituting the character wheel unit.

A still further object of the present invention is to provide a numbering machine which is capable of eliminating uneven inking or variations in ink density by ensuring that the ink roller presses and contacts the printing surfaces of the respective character wheels, which construct the character wheel device, with a uniform pressing force at all times, thereby permitting highly accurate and sharp printing.

A further object of the present invention is to provide an ink roller device which is capable of impregnating the ink roller with a large amount of ink and oozing an appropriate amount of the ink onto the surface of the roller by making use of the capillary phenomenon or elastic resetting force so as to ensure a prolonged service life.

These and other objects of the present invention can be achieved by providing, in one aspect, an ink roller device comprising a roller holding frame provided with an operating handle and having a pair of engaging grooves, an ink roller which is detachably and rotatably held in the engaging grooves, and guide discs which are installed on both longitudinal side ends of the ink roller and each of which has a larger diameter than that of the roller, wherein the roller holding frame is provided with an elastic retaining section for fixing the holding frame.

With this arrangement, the pair of the engaging grooves formed in the roller holding frame equipped with the operating handle allow the ink roller to roll and to be attached or detached, so that the ink roller can be easily and quickly attached or detached in an easy-to-replace place.

In addition, the guide discs each of which has a larger diameter than that of the roller and which are provided on both side ends of the ink roller effectively prevent the rolling surface of the ink roller from coming in contact with something around it and soiling it. This feature makes it possible to replace the ink roller without the need of holding the roller, so that the ink roller can be detached and attached efficiently without staining the hands.

In a preferred form of the present invention of this aspect, the ink roller in the ink roller device is comprised of an open-cell elastic sponge roller which is impregnated with ink and which is mounted on a roller shaft.

With this arrangement, the open-cell elastic sponge roller impregnated with ink is mounted on the roller shaft to construct the ink roller, making it possible to impregnate the ink roller with a large amount ink. The ink roller is pressed by the printing elements of the character wheels and it rolls and contacts them, so that a new roller surface area contacts the printing elements at all times. In addition, the entire roller surface effectively and efficiently contacts the printing elements, resulting in a prolonged service life of the ink roller.

According to another aspect of the present invention, there is provided a numbering machine which comprises a numbering main body comprised of a frame, a character wheel unit which is incorporated in the main body so that it is allowed to move up and down between a printing position and a home position thereof, operating means equipped with an operating knob which enables the character wheel unit to be depressed against a spring force of a resetting spring disposed in the operating means, a swinging arm mechanism which is provided on the numbering main body to be swingable when the operating knob is depressed, and a cassette-type ink roller device which is detachably held at a bottom portion of the swinging arm mechanism, wherein the ink roller device has an ink roller which is detachably mounted on a roller holding frame and the ink roller rolls to contact the printing surfaces of the printing elements constructing the character wheel unit so as to apply ink to the printing surfaces.

With this arrangement, the swinging arm mechanism, which can be swung as the operating knob is depressed, is provided in the numbering main body and the cassette-type ink roller device is detachably held at the bottom of the swinging arm mechanism. Therefore, the ink roller device can be quickly and easily attached or detached. In addition, since the ink roller of the ink roller device is detachably mounted on the roller holding frame, the ink roller device can be removed from the numbering machine to replace the ink roller in a convenient place. This permits easy and smooth installation or removal of the ink roller on or from the ink holding frame.

In addition, when printing with the numbering machine, the ink roller device, which is detachably held at the bottom portion of the swinging arm mechanism, allows the ink roller to roll and contact the printing elements of the character wheel unit, so that new roller surface spots come in contact with the printing elements one after another constantly. This feature assures efficient use of the entire roller surface of the ink roller with a consequent prolonged service life of the roller.

In a further preferred form of the present invention of this aspect, the numbering machine is equipped with a swinging arm mechanism which is supported so that it is allowed to swing around a horizontal supporting shaft at the top portion of the numbering main body, the swinging arm has a slant cam surface in the middle portion thereof so that an engaging projection of the character wheel device comes in contact with the cam surface, the cam surface of the swinging arm triggers the initial operation of the swinging arm mechanism, and the locus of the cam surface is designed so that the contact area of the ink roller which rolls to come in contact with the printing surfaces of the printing elements stays approximately constant.

The swinging arm mechanism is equipped with a swinging arm supported so that it is allowed to swing around the horizontal supporting shaft at the top portion of the numbering main body and a connecting link supported by the character wheel unit, the swinging arm and the free end of the connecting link are connected by the engagement between an engaging pin of one of the swinging arm and the connecting link and a cam hole in the other one of them to constitute a cam link mechanism which triggers the initial operation of the swinging arm mechanism, and the shape of the cam hole is formed to ensure an approximately constant contact area of the ink roller which rolls to come in contact with the printing surfaces of the printing elements.

With this arrangement, the engaging projection for the character wheel unit which is provided on the cam surface formed on the swinging arm of the swinging arm mechanism makes sure that, when the character wheel unit moves down and the swinging arm mechanism moves, the initial operation of the swinging arm mechanism is triggered so as to ensure smooth movement of the swinging arm. Also at the same time, the movement of the swinging arm is controlled by the locus of the cam surface so that the contacting area of the ink roller which rolls and contacts the printing elements stays nearly constant. This feature makes it possible to maintain a constant contact area of the ink roller (strictly speaking, the area of contact between the ink roller and the printing elements) all over the surfaces of the printing elements, thus assuring uniform application of ink to the printing elements.

Regarding the swinging arm mechanism, instead of providing the swinging arm with the cam surface, the swinging arm and the free end of the connecting link are linked using the engaging pin and the cam hole of the required shape. This also makes it possible to maintain the fixed contact area of the ink roller all over the printing elements, thus assuring uniform application of ink to the printing elements.

In a still further preferred form of the present invention, the numbering machine has a comb-shaped guide grooves on one side of a printing window formed in the bottom plate of the numbering main body so that the guide grooves face against the respective character wheels of the character wheel unit, the other side of the printing window is formed into a stopper which can be engaged with the distal end of a printing element shifting bar, and the guide projection in the axial direction of the printing element shifting bar is slidably engaged in one of the guide grooves.

With this arrangement, while the distal end of the printing element shifting bar is engaged with the side section of the printing element of the character wheel, the guide projection in the axial direction of the printing element shifting bar can be engaged with a guide groove, which has been selected among the comb-shaped guide grooves and then slid. This makes it easy to shift the digit one at a time while protecting the printing surface of the printing element of the character wheel, thus permitting easy and quick feed of the character wheels of the respective digits.

The nature and further features of the present invention will be made more clear from the following descriptions made with reference to the accompanying drawings.

DESCRIPTION OF THE PREFERRED EMBODIMENTS

Figure 1:
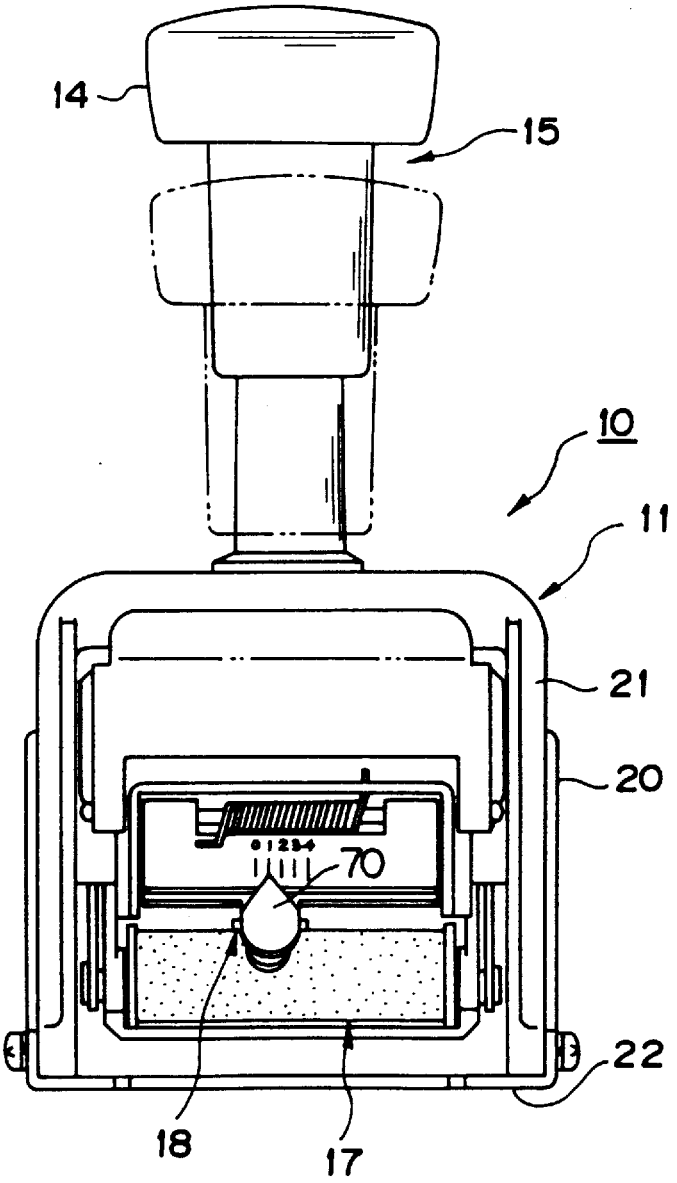
FIG. 1 is a front view of an embodiment of a numbering machine in accordance with the present invention.
Figure 2:
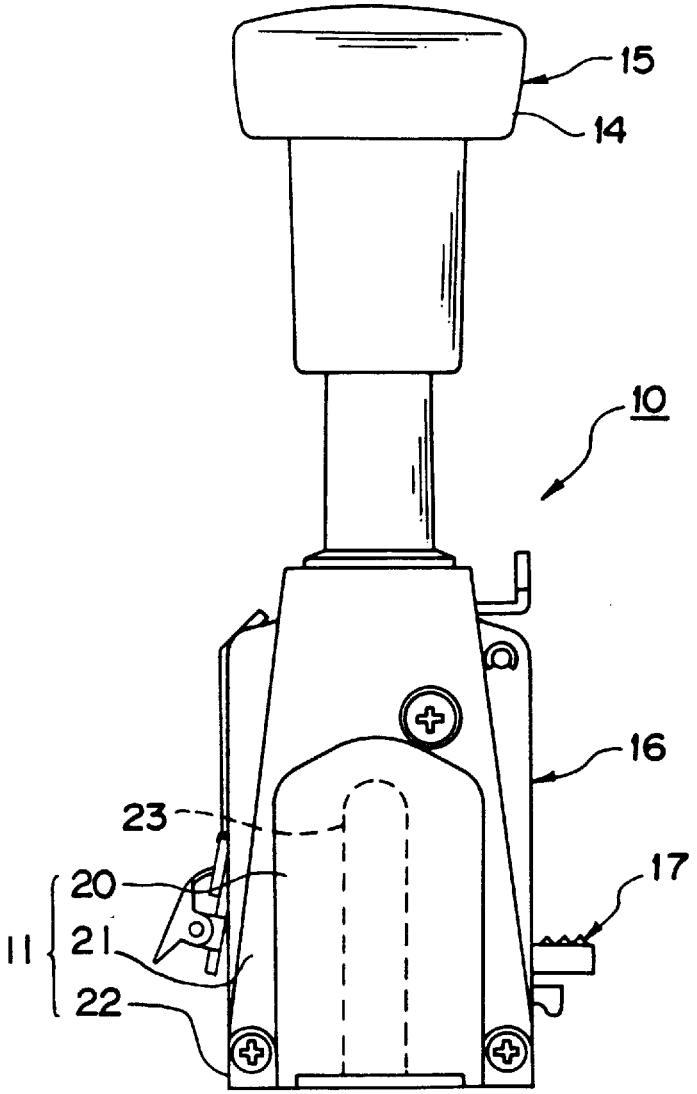
FIG. 2 is a right side view of the embodiment of the numbering machine in accordance with the present invention.
Figure 3:
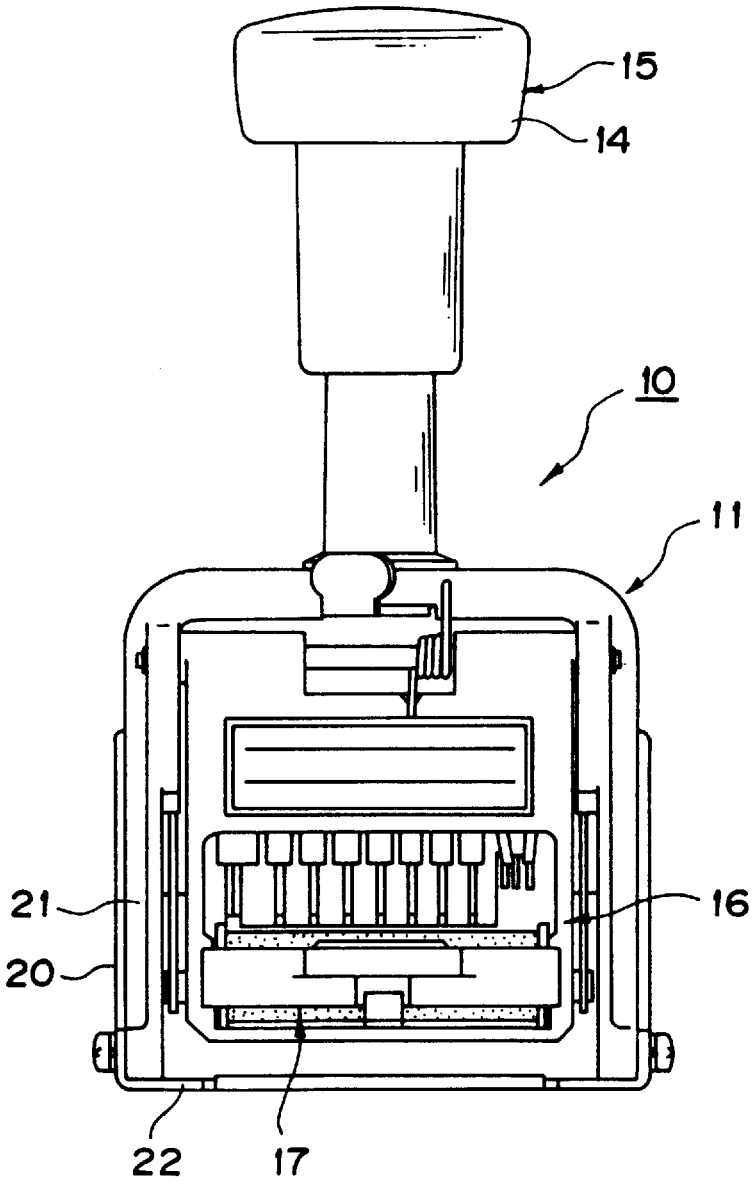
FIG. 3 is a rear view of the embodiment of the numbering machine in accordance with the present invention.

Other objects and advantages of this invention will become apparent from the following detailed description given in connection with the accompanying drawings.

FIG. 1 through FIG. 4 are the front view, right side view, the rear view, and the longitudinal section, respectively, of the first embodiment of the numbering machine in accordance with the present invention. The numbering machine is a printing device for numbering a printed document such as an office document. The entire numbering machine is denoted by 10. The numbering machine 10 prints 7-digit numbers and it measures, for example, 67 mm wide, 143 mm high, and 40 mm deep.

The numbering machine 10 has a numbering main body 11 composed of a frame, a character wheel unit 12 which is incorporated in the numbering main body 11 so that it is allowed to move up and down between the printing level and the home position thereof, an operating means 15 equipped with an operating knob 14 which depresses the character wheel unit 12 against the spring force of a resetting spring 13, a swinging arm mechanism 16 which can be swung as the operating knob 14 is depressed, a cassette-type ink roller device 17 which is detachably installed at the bottom of the swinging arm mechanism 16, and a printing number of times selector 18 for selecting how many times the character wheel unit 12 should print.

The numbering main body 11 is constituted by a gate-shaped frame 21, which is equipped with reinforcing side plates 20, and a bottom plate 22 fastened to the bottom end of the gate-shaped frame 21, the gate-shaped frame 21 and the bottom plate 22 being combined into one piece. The opposing insides of the reinforcing side plates 20 of the numbering main body 11 are provided with lifting guide grooves 23 for guiding the vertical movement of the character wheel unit 12. Both ends of a character wheel shaft 25 of the character wheel unit 12 are slidably engaged with the lifting guide grooves 23 to guide the vertical movement. The reinforcing side plates 20 are fixed to the gate-shaped frame 21. However, they may alternatively be made by one-piece molding.

Figure 4:
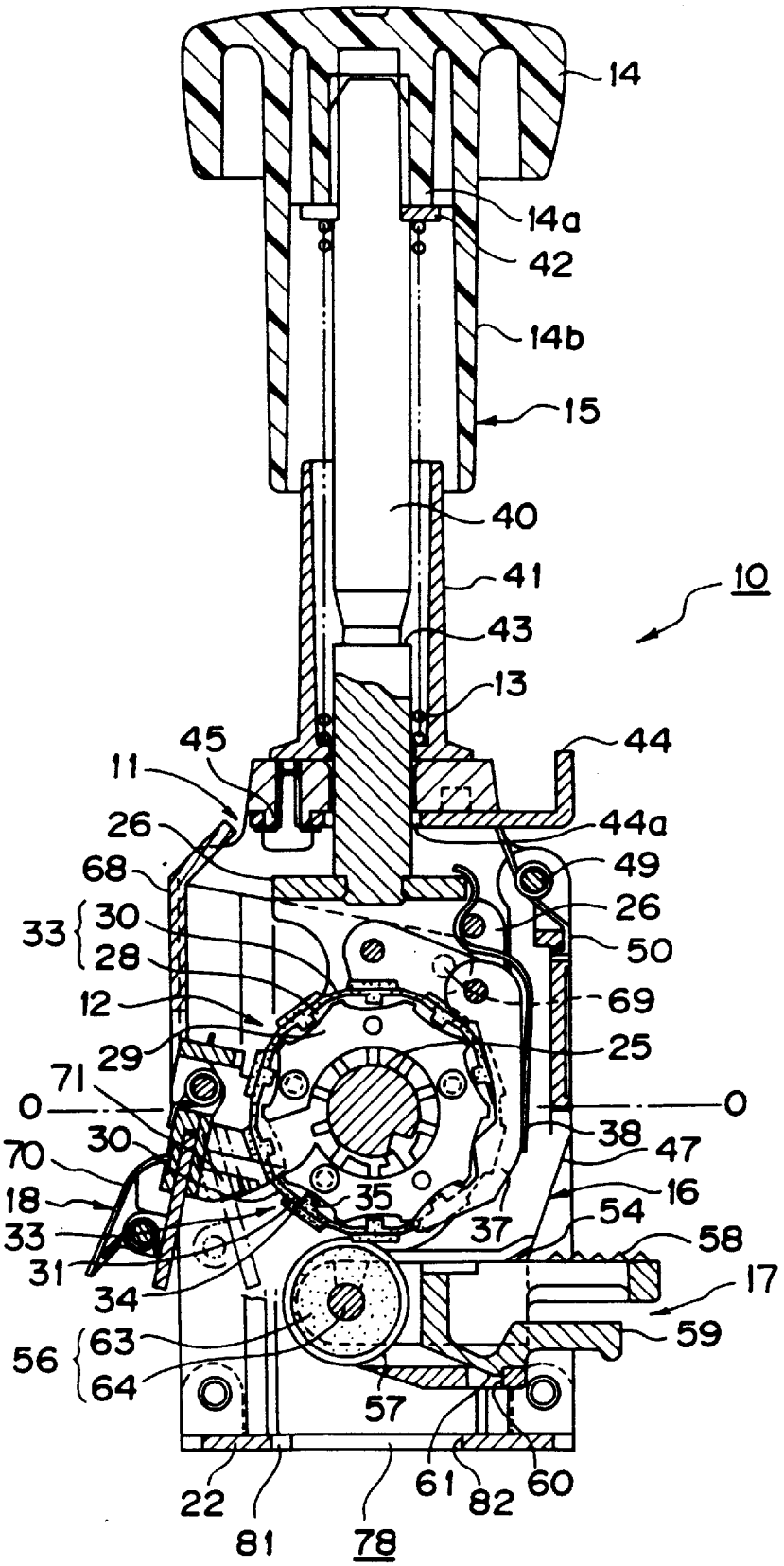
FIG. 4 is a longitudinal section of the embodiment of the numbering machine in accordance with the present invention.

As shown in FIG. 4, the character wheel unit 12 has a character wheel holder 26 composed of a gate-shaped frame, the character wheel shaft 25 which is positioned by a shaft positioning disc 27 (see FIG. 11 through FIG. 15), a plurality of character wheel discs 28 which are rotatably mounted on the character wheel shaft 25 and which are overlapped on top of each other, a ratchet disc 29 which is fixed on the side surface of the character wheel discs 28, and a flexible annular character wheel band 30 which is mounted around the outer peripheries of the character wheel discs 28. The character wheel band 30 is made by one-piece molding of a resinous material such as rubber or plastics which is compatible with ink, for example, ten printing elements 31 are endlessly arranged without a break at fixed intervals. Each printing element 31 is equipped with a printing section which has a printing surface of a numeral, symbol, character, etc.

A character wheel 33 is constructed by fixing the character wheel band 30 around the peripheries of the character wheel discs 28. Engaging projections 34 are provided on the rear surfaces of the respective printing elements 31 of the character wheel band 30, and the engaging projections 34 are engaged with engaging grooves 35 formed in the peripheral surfaces of the character wheel discs 28 to fasten the character wheel band 30 on the character wheel discs 28 without causing relative displacement in the circumferential direction.

Reference numeral 37 denotes a reverse rotation preventing member for preventing the character wheel 33 from turning in the reverse direction; the reverse rotation preventing member 37 meshes with the feeding ratchet disc 29, which is urged by a spring 38 to be mounted on the character wheel 33, to press the character wheel 33 to prevent it from turning in the reverse direction. The feeding ratchet disc 29 may be integrally molded with the character wheel discs 28.

The character wheel unit 12 is moved up and down by manually operating the operating means 15. The operating means 15 has an operating shaft 40 which is fixed on the top of the character wheel holder 26 of the character wheel unit 12, the operating knob 14 which is screwed to the top of the operating shaft 40, and the resetting spring 13 which urges the operating knob 14 toward the initial position, i.e. the home position, thereof. The bottom end of the operating shaft 40 is fixed to the character wheel holder 26. The operating shaft 40 extends upward beyond a protective cylinder 41 provided on the top of the numbering main body 11, and the operating knob 14 is screwed onto the top end of the shaft. The resetting spring 13 is mounted between the proximal end of the protective cylinder 41 and a spring shoe 42 installed on a boss 14*a* of the operating knob 14, and it urges the operating knob 14 in the home position at all times. The resetting spring 13 is always covered by a protective sleeve 14*b* of the operating knob 14 and the protective cylinder 41 to prevent it from being exposed outside.

Figure 5:
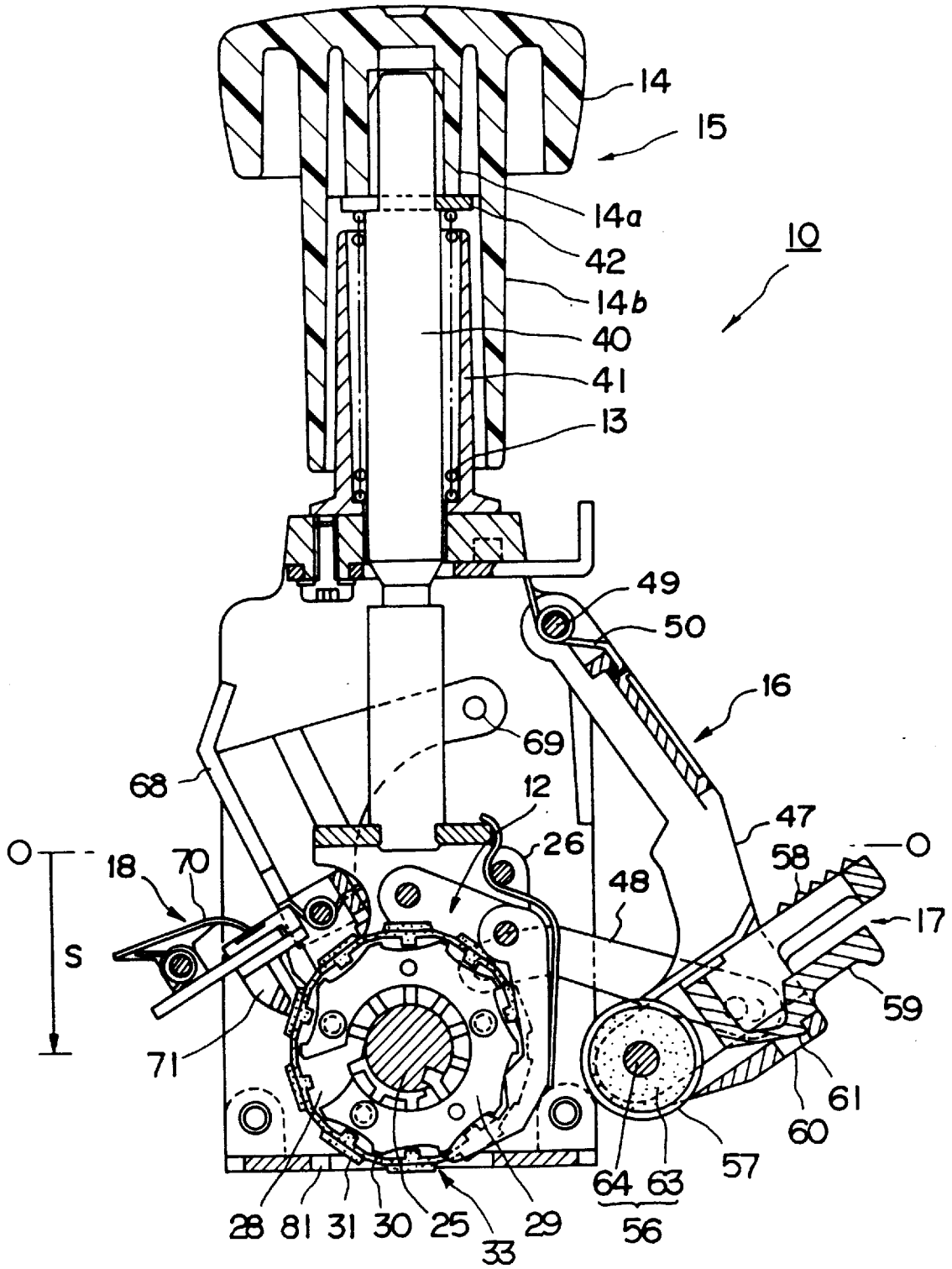
FIG. 5 is a longitudinal section showing the numbering machine in accordance with the present invention under printing condition.

Depressing the operating knob 14 against the spring force of the resetting spring 13 causes the character wheel unit 12 to move in response to the movement of the operating knob 14. The character wheel unit 12 moves down while being guided by the lifting guide grooves 23 of the numbering main body 11 until it reaches the printing level as shown in FIG. 5. When the depression of the operating knob 14 is stopped, the character wheel unit 12 is moved up back from the printing level to the home position, i.e. the initial position, shown in FIG. 4 by the spring force of the resetting spring 13.

Figure 6:
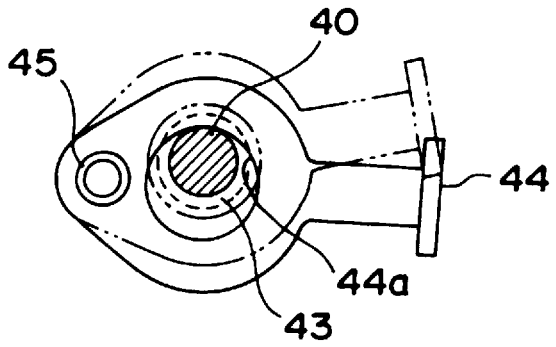
FIG. 6 is a top plan view of a locking lever which locks an operating means of the numbering machine in accordance with the present invention.

In the operating means 15, the operating shaft 40 has a necked-in section in the middle thereof, and the necked-in section provides the operating shaft 40 with a shoulder 43, so that a locking section 44*a* of a locking lever 44 can be engaged with the shoulder 43. The locking lever 44 is rotatably supported around a vertical supporting shaft 45 at the top of the numbering main body 11 so that it swings between the locking position indicated by the solid line and the unlocking position indicated by the chain line as shown in FIG. 6.

Figure 7:
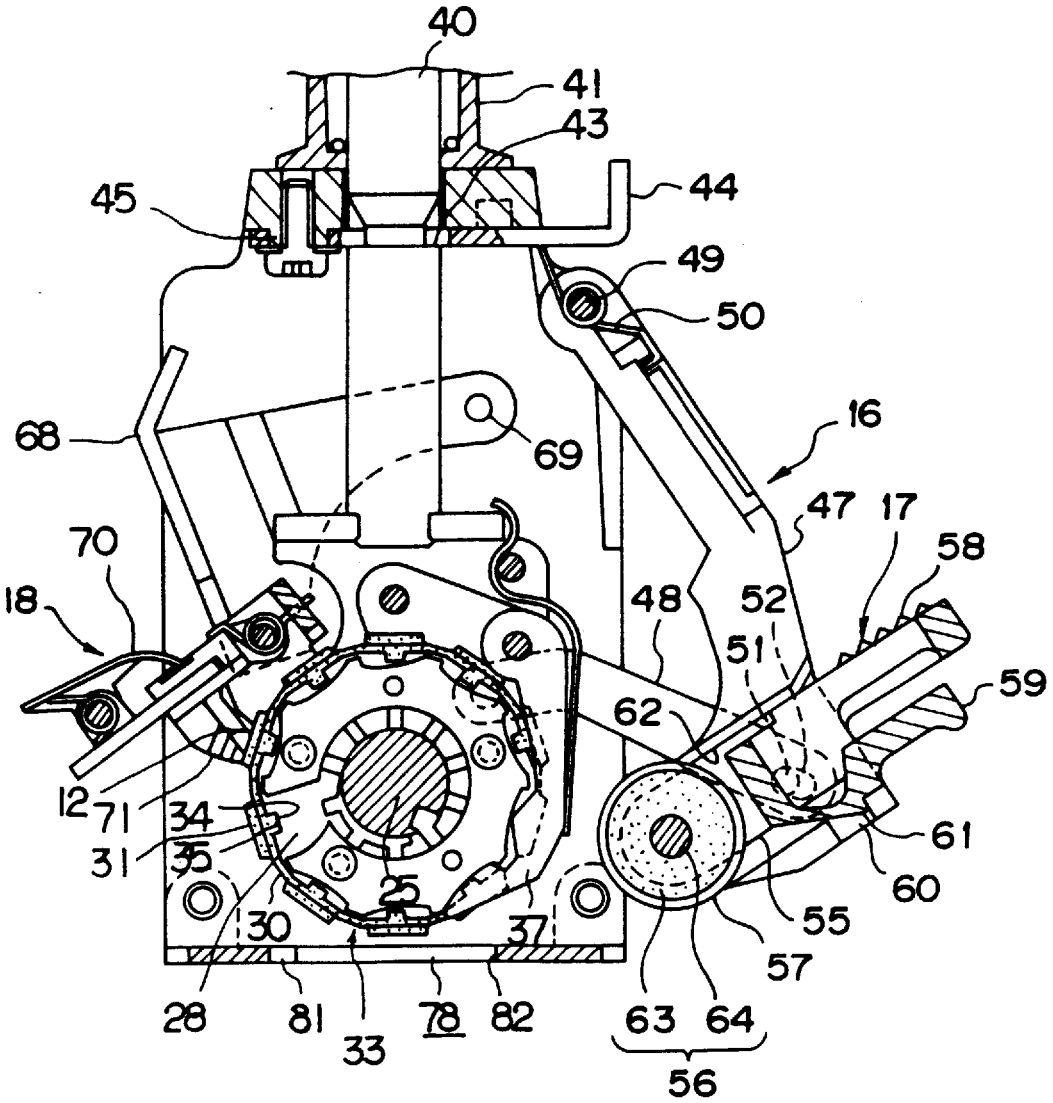
FIG. 7 is a cross-sectional view showing the numbering machine which has been locked with a locking lever shown in FIG. 6.

When the operating shaft 40 of the operating means 15 is locked by the locking operation of the locking lever 44, the numbering machine 10 is locked with the swinging arm mechanism 16 opened as illustrated in FIG. 7 and the locked condition is maintained.

The swinging arm mechanism 16 is located at the rear portion of the numbering main body 11 as shown in FIG. 4, FIG. 5 and FIG. 7. The swinging arm mechanism 16 has a swinging arm 47, which is provided at the rear top of the numbering main body 11 in a manner that it is allowed to swing, and a pair of connecting links 48 which are provided on both sides at the rear of the character wheel holder 26 of the character wheel unit 12 in a manner that they are allowed to swing. The swinging arm 47 is rotatably supported around a horizontal supporting shaft 49 which is provided at the top rear of the numbering main body 11. It is normally urged clockwise in the drawing by a spring 50.

As shown in FIG. 4, FIG. 5 and FIG. 7, the swinging arm 47 is shaped like a reversed L as observed sideways, the bottom section of the swinging arm 47 being connected with the free end of the connecting link 48 through an engaging pin 51 and a slot 52. The engaging pin 51 is provided, for example, on the swinging arm 47 whereas the slot 52 is provided in the connecting link 48 to give a swinging stroke to the swinging arm 47. As an alternative, the engaging pin 51 may be provided in the connecting link 48 and the slot 52 in the swinging arm 47.

Figure 8:
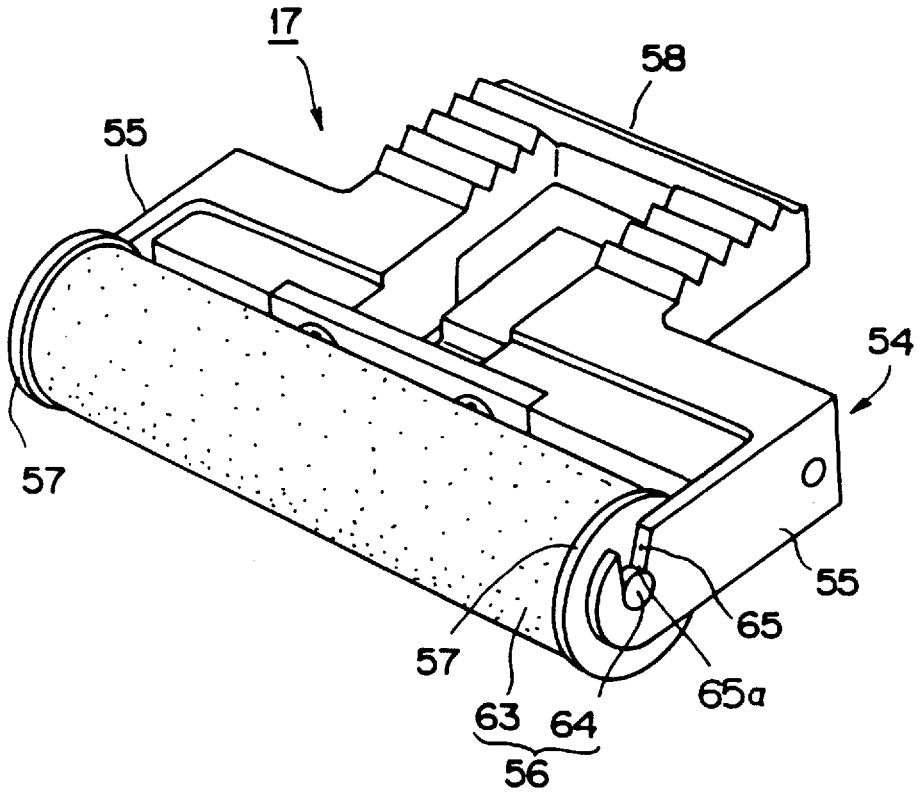
FIG. 8 is a perspective view of a cassette-type ink roller device which is detachably mounted on the numbering machine in accordance with the present invention.

At the bottom of the swinging arm mechanism 16, the cassette-type ink roller device 17 is detachably installed. As shown in FIG. 8, the ink roller device 17 has a roller holding frame 54 composed of a frame, an ink roller 56 which is detachably supported by a pair of side guide arms 55 of the roller holding frame 54, and side discs 57, as guide discs, attached to both sides of the ink roller 56. The guide discs 57 have a larger diameter than the diameter of the ink roller 56, and the presence of the guide discs 57 prevents the hands or an object placed near the ink roller from being stained at the time of detaching or attaching the ink roller 56.

An operating handle 58 for detaching or attaching the ink roller device 17 and an elastic retaining section 59 stick out from the roller holding frame 54 on the side opposite from the side of the ink roller 56. The operating handle 58 and the elastic retaining section 59 are molded integrally with the roller holding frame 54 or constructed with the roller holding frame 54 into one piece. The elastic retaining section 59 is provided with a retaining hook 61 which is engaged with a retaining hole 60 at the bottom of the swinging arm 47 of the swinging arm mechanism 16. The ink roller device 16 is locked and maintained in the locked state by the engagement of the retaining hook 61 with the retaining hole 60 in the swinging arm 47.

The ink roller device 17 is removed from or installed to the bottom section of the swinging arm 47 from the rear side. At this time, the side guide arms 55 of the roller holding frame 54 engage with guide grooves 62 and slide, thus ensuring secure installation and removal of the ink roller device 17.

The ink roller 56 of the ink roller device 17 employs a cylindrical sponge roller 63 of an open-cell foam which has been made by foaming natural or synthetic rubber, plastics, or other foamy resin material. A shaft inserting hole is concentrically formed in the sponge roller 63. The sponge roller 63 is attached onto a roller shaft 64 to constitute the ink roller 56. The guide discs 57 are attached to the roller shaft 64 in such a manner that they hold the sponge roller 63 between them. The roller shaft 64 juts out of the guide discs 57 and the jutting sections, namely, engaging projections 65a, fit in engaging grooves 65 of the side guide arms 55 of the roller holding frame 54 to securely hold the ink roller in place. The engaging grooves 65 of the side guide arms 55 have V- or U-shaped notches which are opened upward, and the ink roller 56 is attached or detached through the V-shaped notch.

The ink roller 56 is attached or detached by operating the locking lever 44 to set the numbering machine 10 in the locked state as shown in FIG. 7. To remove the ink roller device 17 from the swinging arm mechanism 16 of the numbering machine 10, the operating handle 58 and the elastic retaining section 59 of the ink roller device 17 are held and pushed in against the elastic holding force of the elastic retaining section 59, thereby disengaging the retaining hook 61 from the retaining hole 60 to unlock the ink roller device 17.

Figure 9:
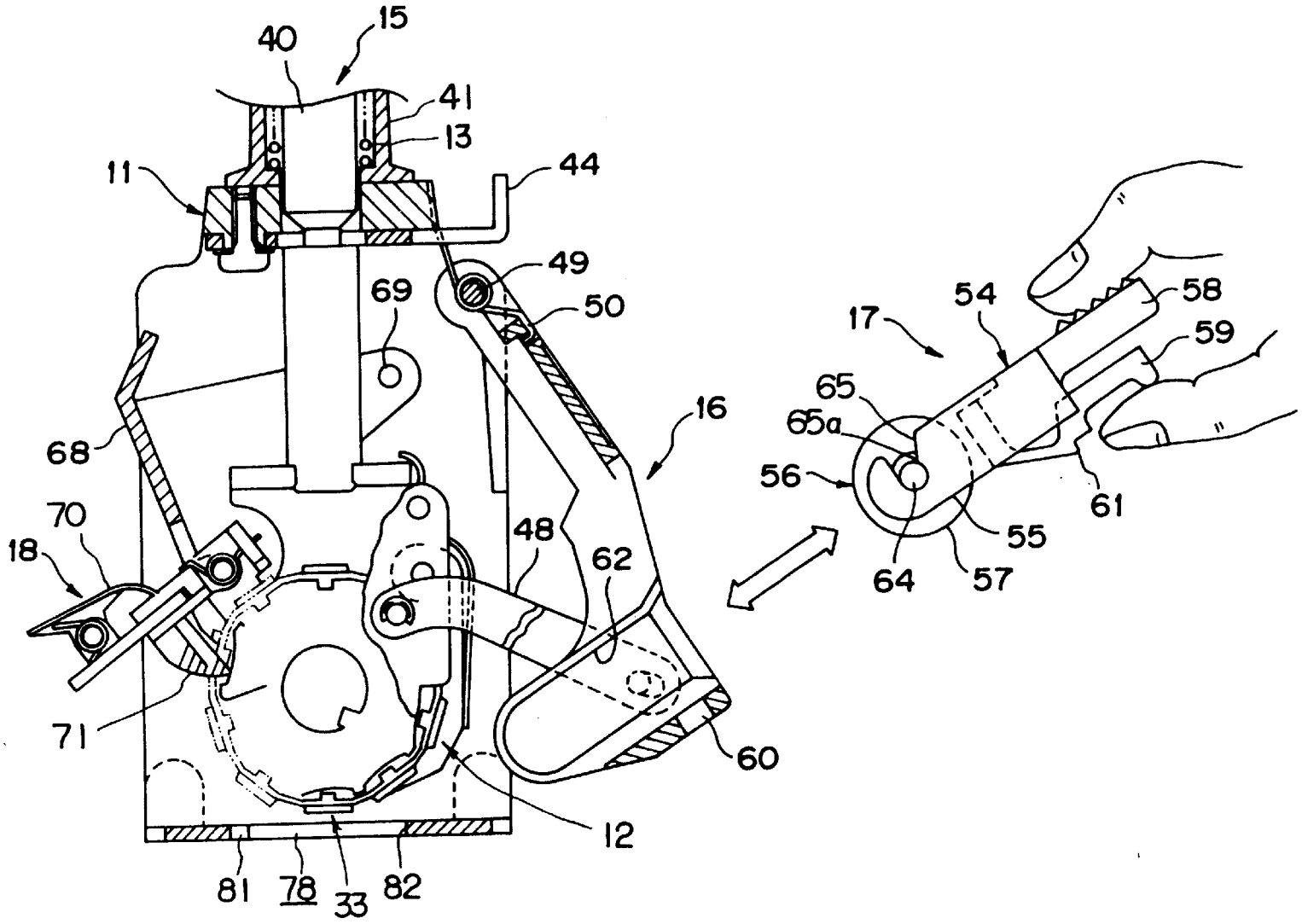
FIG. 9 is a view showing the ink roller which is to be attached to or detached from the numbering machine in accordance with the present invention.

After unlocking, the ink roller device 17 is drawn out as illustrated in FIG. 9, and the roller holding frame 54 of the ink roller device 17 can be smoothly pulled out while it is guided along the guide grooves 62 of the swinging arm 47.

Figure 10A:
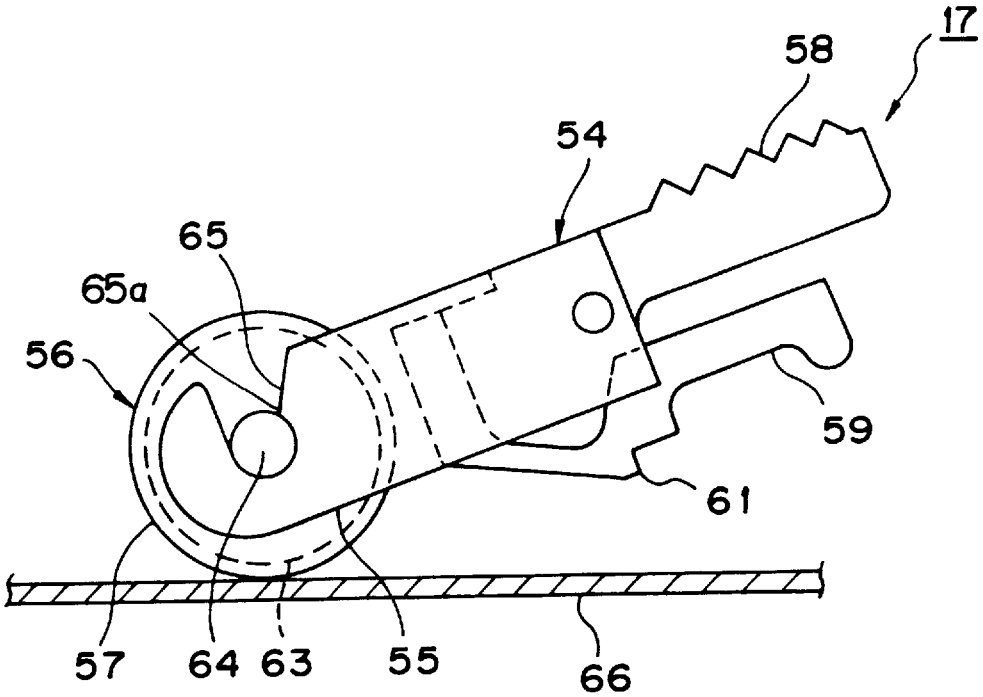
FIG. 10A is a side view showing an example wherein the ink roller is being removed from the ink roller device.

To replace the ink roller 56 with the ink roller device 17 removed from the numbering machine 10, the side discs 57 are placed on a plane table 66 such as a desk top and the roller holding frame 54 is pushed down as illustrated in FIG. 10A. Pushing the roller holding frame 54 down disengages the roller shaft 64 of the ink roller 56 from the engaging grooves 65 because of the elastic deformation of the engaging grooves 65 of the side guide arms 55, thus allowing the ink roller 56 to be easily removed from the cassette-type ink roller device 17.

The guide discs 57, which have a larger diameter than that of the roller and which are attached to both sides of the ink roller 56, make it possible to quickly and easily detach the ink roller 56 from the roller holding frame 54 while preventing the surface of the ink roller from staining the plane table 66.

Figure 10B:
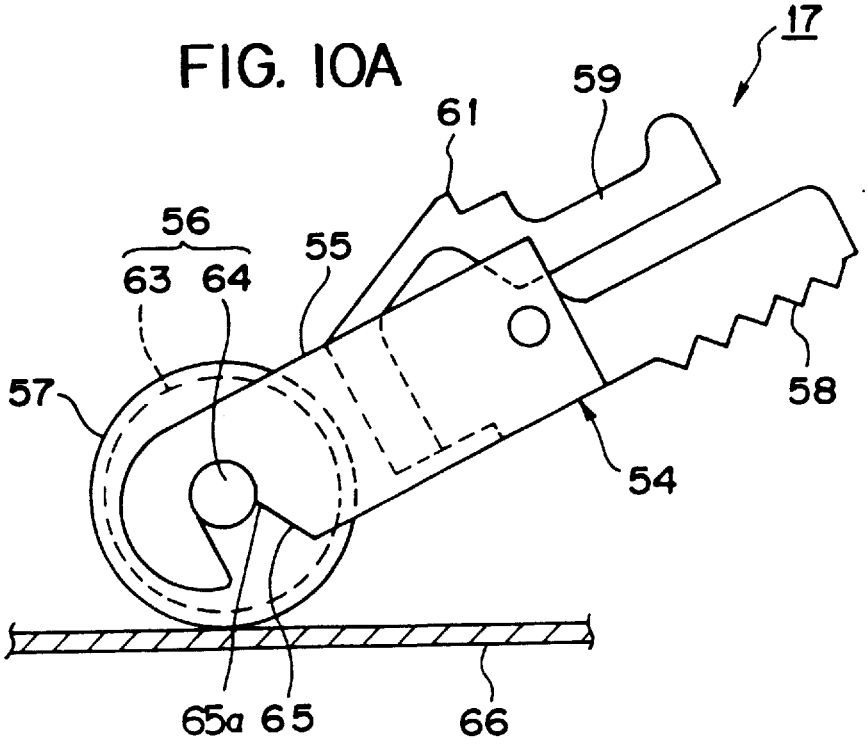
FIG. 10B is a side view showing an example wherein the ink roller is being attached to the ink roller device.

FIG. 10B shows how to attach a new ink roller 56 to the roller holding frame 54. In this case, the roller holding frame 54 is reversed so that the V-shaped engaging grooves 65 of the roller holding frame 54 face downward. With the engaging grooves 65 facing downward, the engaging grooves 65 of the roller holding frame 54 are brought into contact with both ends of the roller shaft 64 of the ink roller 56 and the roller holding frame 54 is pushed down. This makes it possible to easily and quickly attach the ink roller 56, which consists of the sponge roller 63, roller shaft 64, and the guide discs 57, without staining the hands, owing to the elastic deformation of the engaging grooves 65 of the roller holding frame 54. The ink roller 56 may be of a disposable type or an ink-rechargeable type.

The ink roller device 17 with the new ink roller 56 attached is mounted on the swinging arm mechanism 16 of the numbering machine 10 by reversing the removing procedure thereof. When the ink roller device 17, which has been inserted along the guide grooves 62 of the swinging arm 47, reaches a predetermined inserting point, the retaining hook 61 of the elastic retaining section 59 engages with the retaining hole 60 in the swinging arm 47 to lock the ink roller device 17, thus completing the installation of the ink roller device 17. After the completion of the installation, the locking lever 44 is released to set the numbering machine 10 from the locked state shown in FIG. 7 to the ready-for-use state shown in FIG. 4.

The ink roller 56 is impregnated with ink. To impregnate the ink roller with a large amount of ink, the sponge roller 63 constituting the ink roller 56 is designed to have a coarse inner layer and a dense surface layer. As a specific example, the inner layer uses a highly spongy open-cell foam, i.e. low-density foam, whereas the outer layer uses less spongy open-cell foam, i.e. high-density foam. A medium-spongy foam may be added between the inner and outer layers. The sponge roller 63 may be a multi-layer or multi-stage design so that the surface layer has a high density of holes whereas the inner layer has a low density of holes, or so that the density of the holes may vary continuously from high to low density. As another alternative, the holes of the sponge roller 63 may be evenly present throughout the sponge roller.

Reference numeral 68 denotes a front cover which covers the top front of the numbering main body 11. The front cover 68 is free to rotate around a knuckle pin 69 which is fixed to the gate-shaped frame 21 of the numbering main body 11. The printing number of times selector 18 is provided at the bottom of the front cover 68.

The printing number of times selector 18 is used to set the number of times of printing by operating the retaining hook 70 for setting the number of times of printing. When the printing has been performed for the number of times selected by the selector 18, a feeding hook 71 engages with the feeding ratchet 29 of the character wheel unit 12 to sequentially feed the printing element 31 of one digit of the character wheel 33 by one block at a time. The character wheels 33 of the respective digits rotate in response to the movement of that particular character wheel 33 of one digit to accomplish carrying.

In the numbering machine 10, the printing number of times selector 18 is located on the front side of the numbering main body 11 and the swinging arm mechanism 16 at the rear side. However, the positional relationship of the swinging arm mechanism 16 and the printing number of times selector 18 may be reversed.

The swinging arm mechanism 16 has a slant cam surface 73 in the middle of the swinging arm 47 so that an engaging projection 74 formed on the character wheel holder 26 of the character wheel unit 12 engages with the cam surface 73 of the swinging arm 47 as shown in FIG. 11 through FIG. 15. The engaging projection 74 is formed so that the distal end thereof has an arc contact engaging surface.

The engaging projection 74 is provided on the character wheel unit 12 which is moved up and down as the operating means 15 is operated, and the engaging projection 74 is brought in contact with the slant cam surface 73 of the swinging arm mechanism 16 to exercise the cam action. The cam action securely urges the swinging arm 47 of the swinging arm mechanism 16 to give the initial operation to turn counterclockwise in FIG. 12. In addition, by setting an appropriate locus, which includes the tilting angle of the slant surface and the length of the slant surface, for the cam surface 73, the contact area of the ink roller 56 which is pushed against the printing elements 31 of the character wheel unit 12 to come in contact with them, i.e. the area of the contact between the ink roller 56 and the printing elements 31, can be maintained nearly constant all over the printing elements 31.

Figure 11:
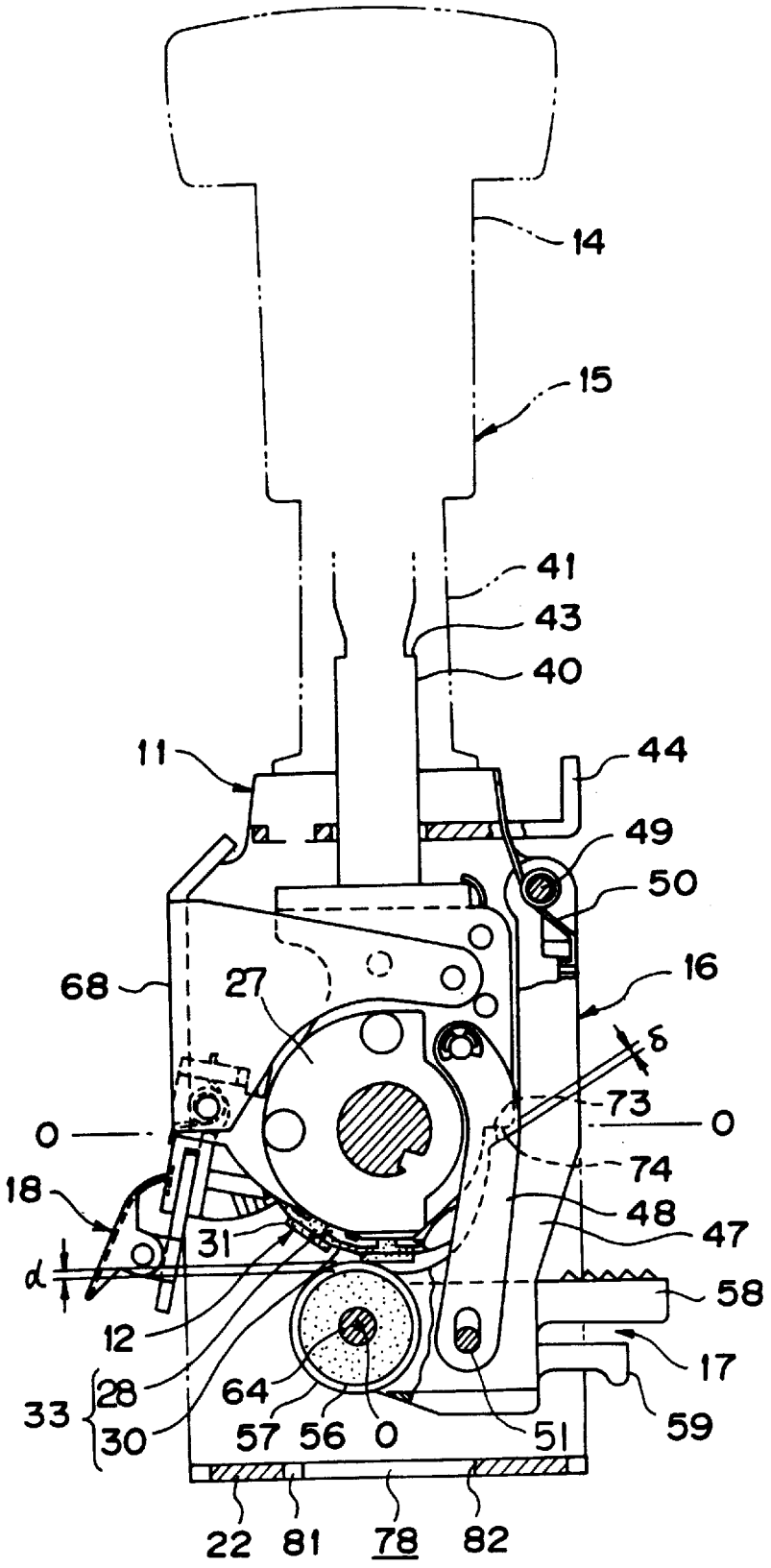
FIG. 11 shows a character wheel unit before use which has been installed in the numbering machine in accordance with the present invention.
Figure 16A:
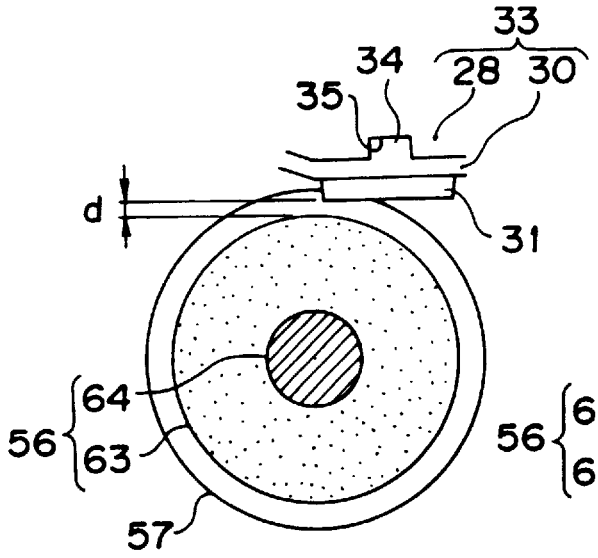
FIGS. 16A through 16D respectively show the positional relationships between the printing elements of the character wheels and the ink roller, which correspond to FIGS. 11 through 14, respectively.

More specifically, as illustrated in FIG. 11, when the lifting stroke, i.e. printing stroke S, of the character wheel unit 12 is zero and the character wheel unit 12 is in its home position (reference surface 0-0), the ink roller 56 of the ink roller device 17 is maintained in a state wherein it is not in contact with the printing elements 31 of the character wheel 33, with a gap d being provided between them as shown in FIG. 16A. For the ink roller 56, the sponge roller 63 having a roller diameter of 11 mm, for example, is used. The sponge roller 63 of the ink roller 56 is concentrically mounted on the roller shaft 64 with high accuracy.

Center O of the ink roller 56 is deviated by about 0.5 mm, for example, toward the front beyond the edge of the printing elements 31 of the character wheel 33. Further, gap δ of 1 mm, for example, which corresponds to a play, is provided between the cam surface 73 of the swinging arm mechanism 16 and the engaging projection (shoulder) 74 of the character wheel unit 12.

Figure 12:
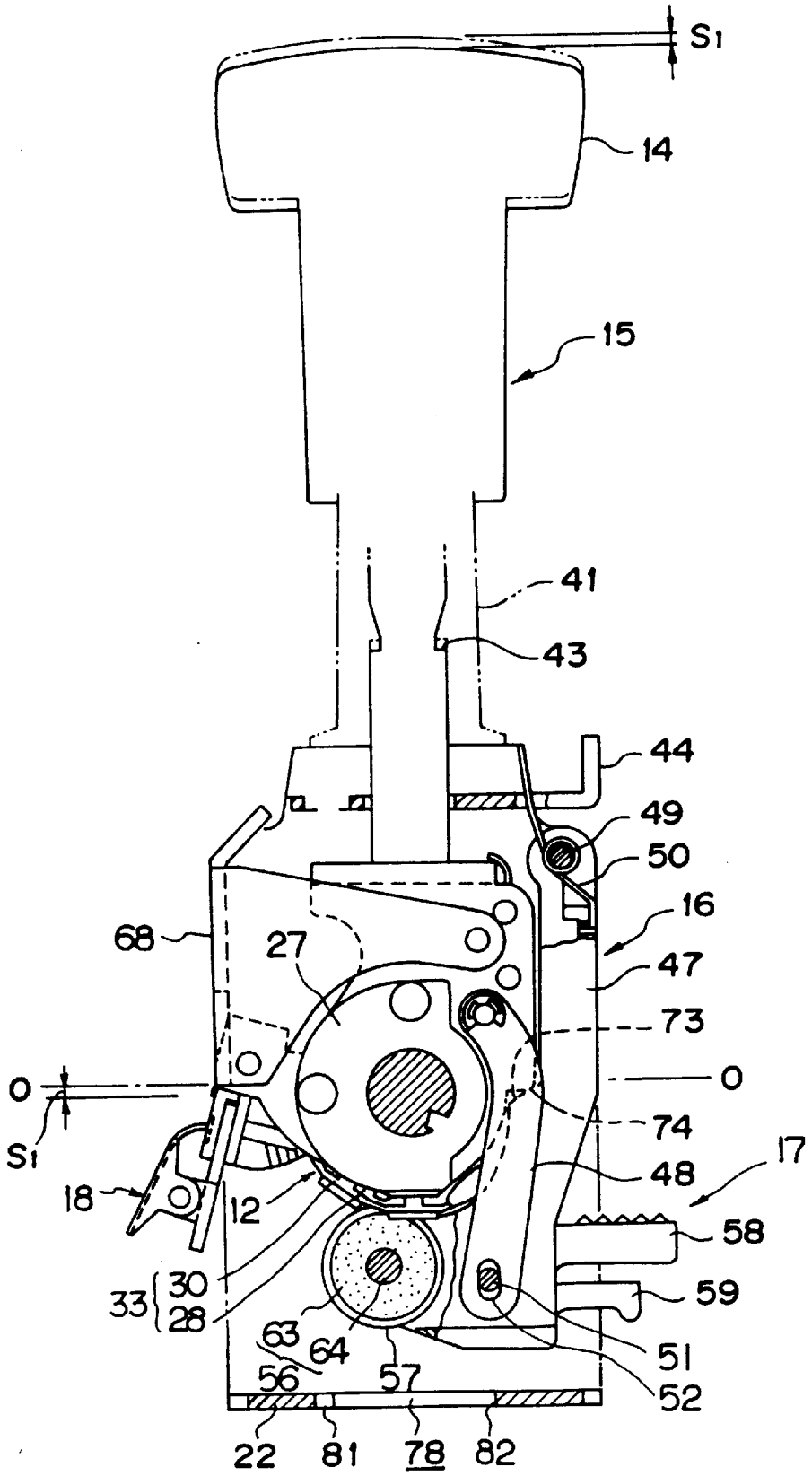
FIG. 12 shows a state wherein the contact to the printing elements of character wheels has begun in the numbering machine in accordance with the present invention.

From the state shown in FIG. 11, if the operating knob 14 is depressed by depressing stroke S1 of approximately 1 mm, for example, as illustrated in FIG. 12, then the engaging projection 74 of the character wheel unit 12 comes in contact with the cam surface 73 of the swinging arm 47 and the gap no longer exists. From this moment, the engaging projection 74 of the character wheel unit 12 starts to press the cam surface 73 of the swinging arm 47 to trigger the initial operation of the swinging arm 47 against the spring force of the spring 50.

Figure 16B:
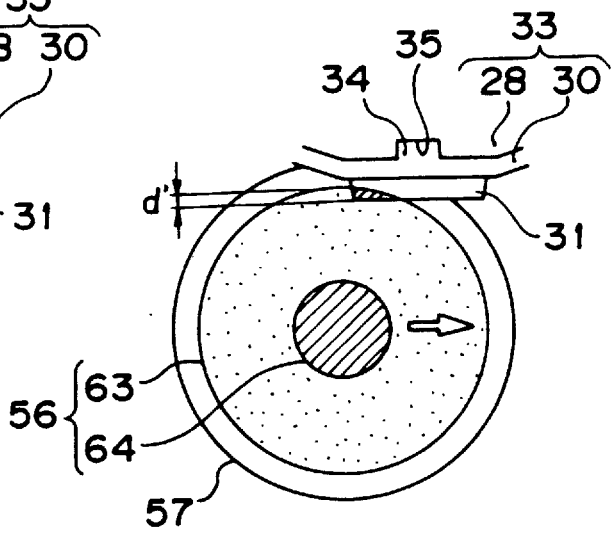
Figure 16C:
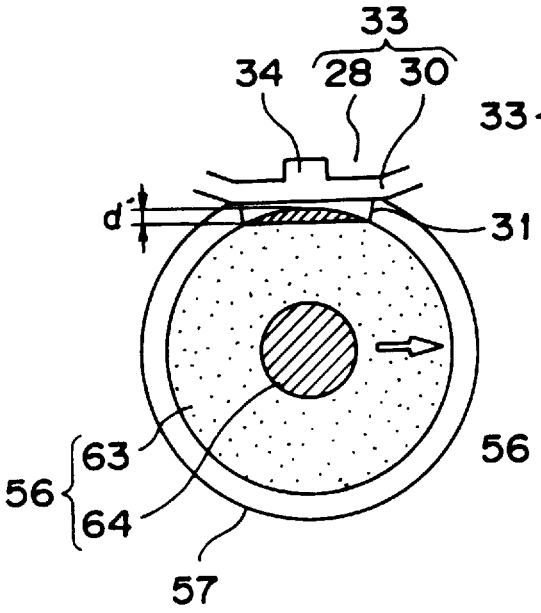
Figure 16D:
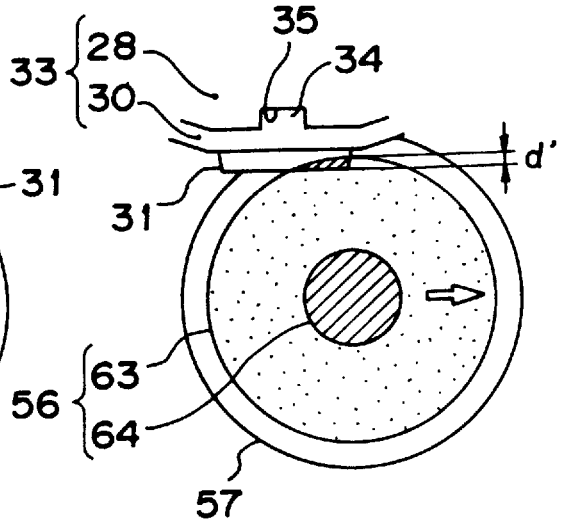

At this time, the printing elements 31 of the character wheel 33 have been pushed by a predetermined amount, e.g. about 0.5 mm, to the roller surface of the ink roller 56 of the ink roller device 17. The ink roller 56 is pressed and deformed by the predetermined amount, for example about 5 mm, by the printing element 31, the locus, including the tilting angle and the length of the cam surface, of the cam surface 73 is adjusted to assure that the contact area based on the deformed amount d' (FIG. 16B, 16C, 16D) of the roller surface stays nearly constant.

When the operating knob 14 is further depressed from the state illustrated in FIG. 12, the engaging projection 74 of the character wheel unit 12 pushes the cam surface 73 of the swinging arm 47, causing the swinging arm 47 to swing counterclockwise with the horizontal supporting shaft 49 serving as the fulcrum thereof in the drawing. The swing of the swinging arm 47 in turn causes the ink roller 56 to turn along the printing elements 31 of the character wheel 33 and go through the state (depressing stroke S2) shown in FIG. 13 before it reaches the state (depressing stroke S3) shown in FIG. 14 where it rolls in contact with the printing elements 31.

At this time the ink roller 56 of the ink roller device 17 turns around the horizontal supporting shaft, i.e. arm fulcrum, 49 of the swinging arm 47, and the swinging angle is controlled by the cam surface 73 of the swinging arm 47. The cam surface 73 of the swinging arm 47 maintains the deformed amount d' of the ink roller 56 at about 0.5 mm, for example, from the moment when the printing elements 31 of the character wheel 33 begins contacting the ink roller 56 (see FIG. 12 and FIG. 16B) to the moment they ends contacting (see FIG. 14 and FIG. 16D).

Figure 13:
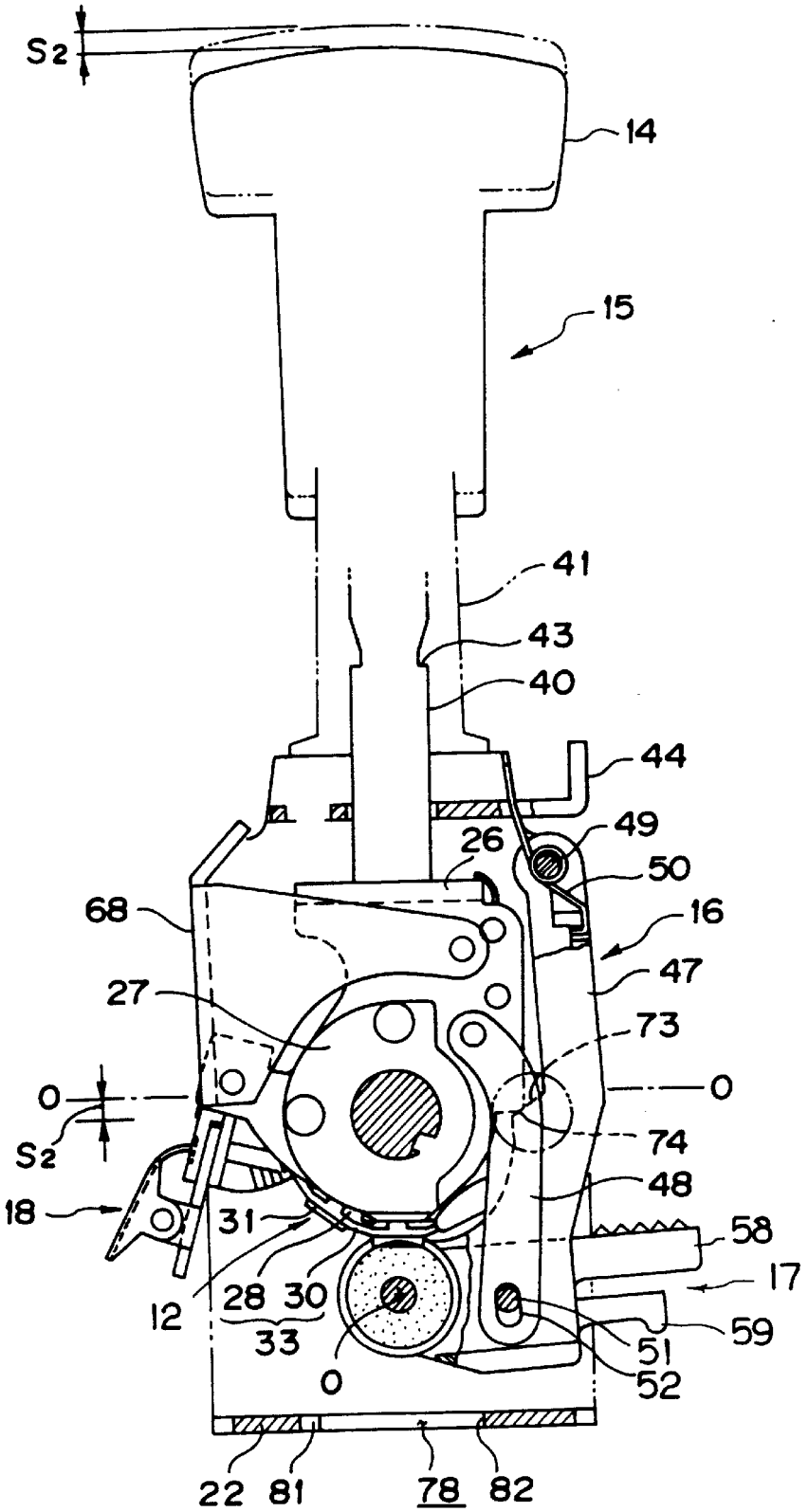
FIG. 13 shows a state wherein the ink roller is rolling to contact the printing elements of the character wheels in the numbering machine in accordance with the present invention.
Figure 14:
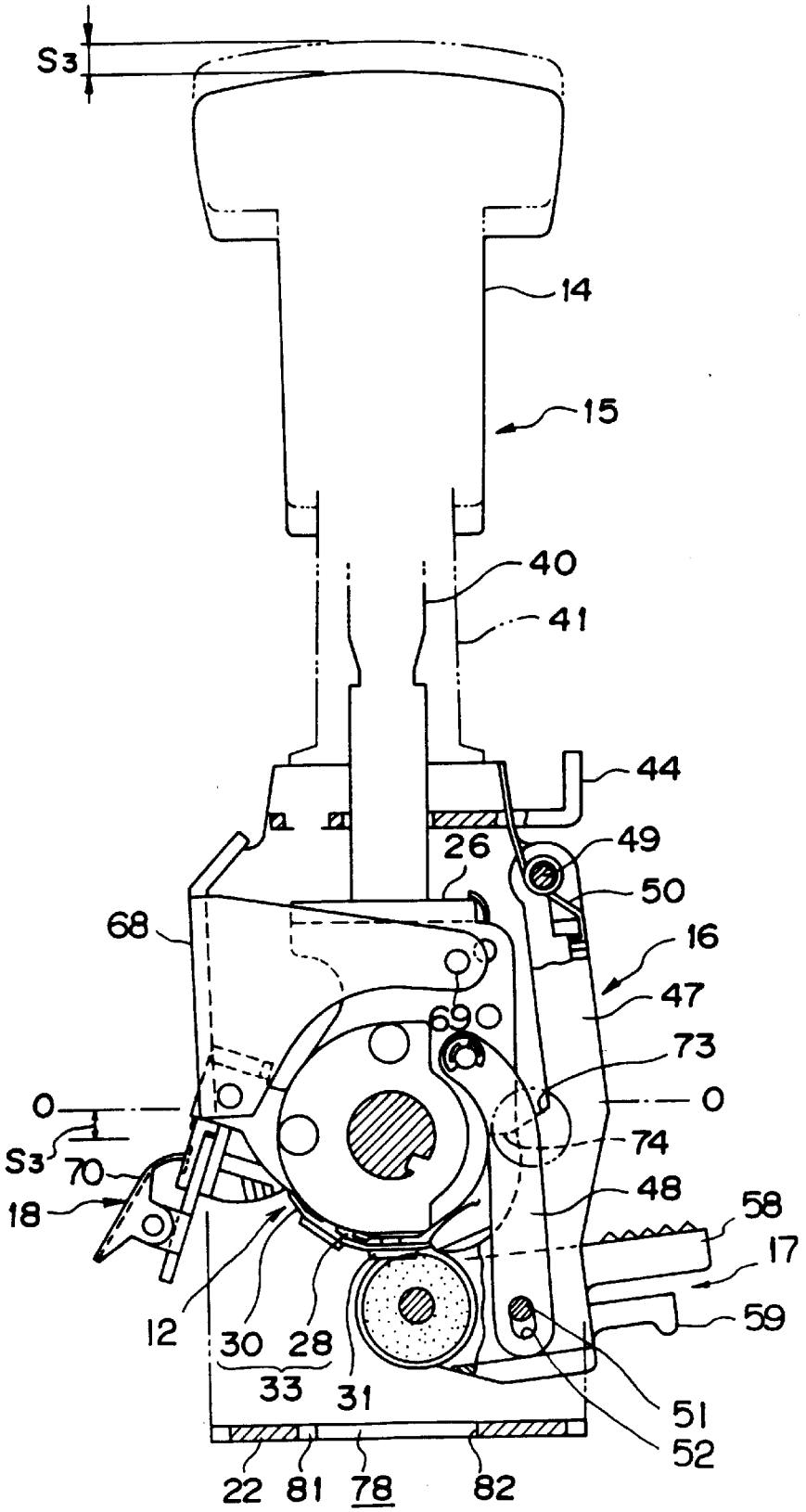
FIG. 14 shows the moment of the end of the contact of the ink roller to the printing elements of the character wheels in the numbering machine in accordance with the present invention.

When the ink roller 56 passes the point shown in FIG. 13, namely, the center of the printing elements 31 of the character wheel 33, and reaches the contact end point shown in FIG. 14, the engaging projection 74 of the character wheel device 12 disengages from the cam surface 73 of the swinging arm 47, whereas the top surfaces of the slots 52 of the pair of connecting links 48 push the engaging pin 51 of the swinging arm 47, so that the connecting links 48 push the swinging arm 47. This causes the ink roller 56 to leave the printing elements 31 of the character wheel 33 to go back in the state wherein it is no longer in contact with the printing elements 31, and it also causes the roller surface of the ink roller 56 to reset by the elastic resetting force of the sponge thereof.

Figure 15:
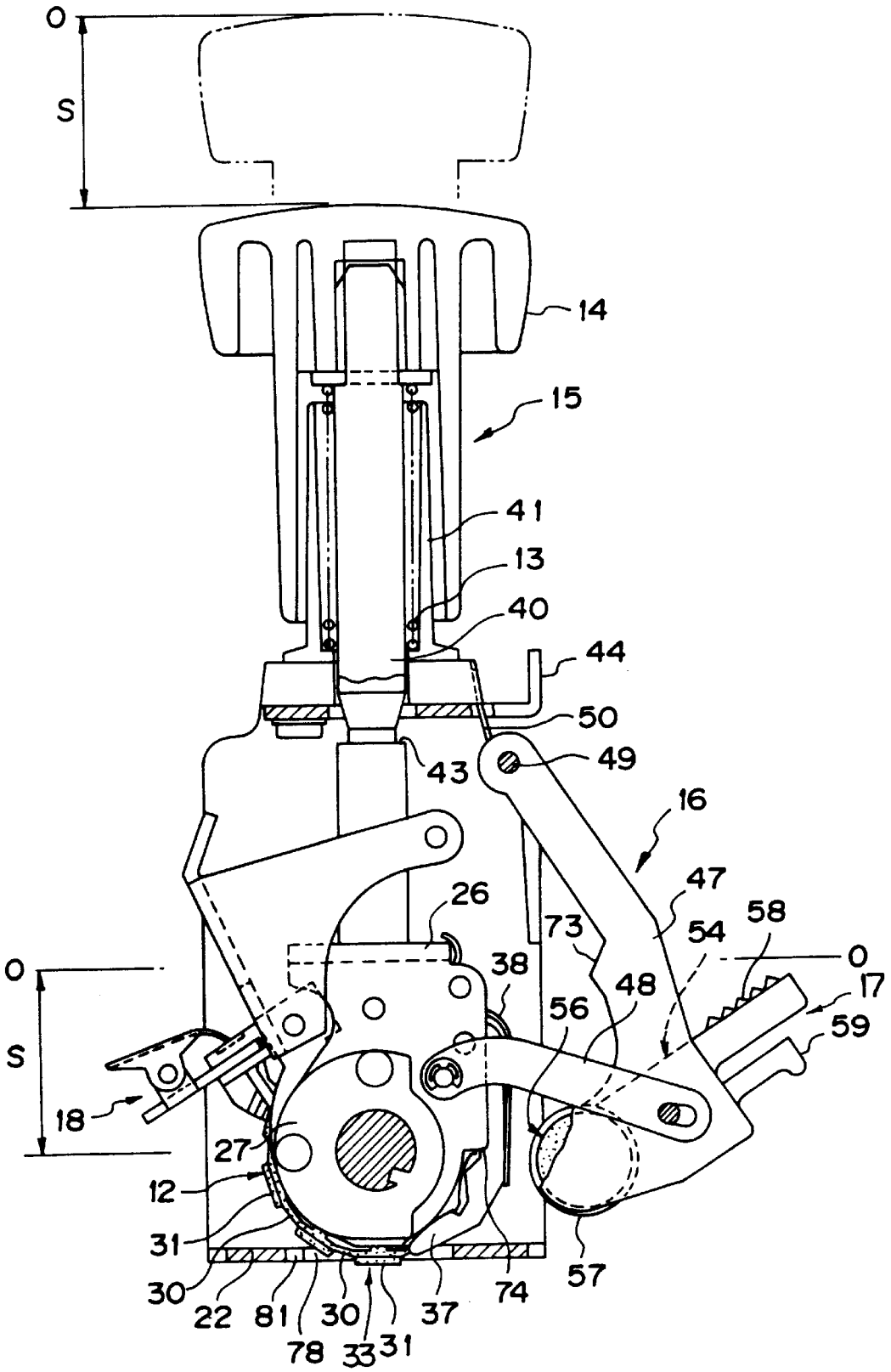
FIG. 15 shows the numbering machine in accordance with the present invention which is printing.

After that, the ink roller 56 quickly leaves the printing elements 31 of the character wheel 33 while the connecting links 48 keep on pressing the swinging arm 47, then the character wheel unit 12 goes down by printing stroke S, e.g. approximately 22 mm, to the printing level shown in FIG. 15.

At the printing level, the printing element 31 of the character wheel 33 of the character wheel unit 12 juts out from a printing window 78 in the bottom plate 22 of the numbering main body 11 and the printing surface comes in contact with a document to be printed such as an office document, thereby performing the printing.

When the operating knob 14 is released after the printing is performed by the numbering machine 10, the spring force of the resetting spring 13 moves the character wheel unit 12 up to the initial position, i.e. home position, to be set ready for the next numbering operation.

The ink roller 56 rolls in contact with the printing element 31 of the character wheel 33 under pressure to apply the ink from the ink roller 56 to the printing element 31. Thus, the roller surface of the ink roller 56 is compressed and deformed in contacting the printing element 31 of the character wheel 33, so that new roller surface spots come in contact with the printing element 31 to assure uniform application of the ink to the printing surface of the printing element 31. As the ink roller is compressed and deformed, the ink oozes out and new roller surface spots contact the printing surface one after another, so that the entire roller surface is effectively used. This enables uniform application of the ink by the ink roller 56 without causing variations in the ink density and it also prolongs the service life of the roller.

The ink roller 56 is pressed against the printing element 31 of the character wheel 33 and the contact area of the compressed and deformed ink roller 56 (strictly speaking, the area of the contact between the ink roller 56 and the printing element 31) is maintained nearly constant all over the printing surface to transfer the ink onto the printing element 31. After the transfer of the ink, the roller surface of the ink roller 56 leaves the printing element 31 and it is reset to the home position thereof by the elastic resetting force. At the time of resetting, the ink impregnated inside the ink roller 56 is moved toward the surface layer and the capillary phenomenon of the ink roller 56 also urges the ink to move to the roller surface layer, enabling the ink roller 56 to always continue stable supply of the ink to the printing element 31.

The numbering machine 10 shows an example wherein the rolling contact of the ink roller 56 is guided by the cam surface 73 of the swinging arm 47 when the ink roller 56 of the ink roller device 17 is brought in roll-contact with the printing element 31 of the character wheel 33. As an alternative, a cam surface may be formed on the bottom surface of the character wheel holder 26 of the character wheel unit 12 and the guide discs 57 of the ink roller 56 may be rolled on the cam surface to bring the ink roller 56 into roll-contact with the printing element 31 of the character wheel 33. This will also make it possible to maintain a constant contact area of the ink roller 56.

The feeding operation of the character wheel unit 12 in the numbering machine will now be described.

Figure 17:
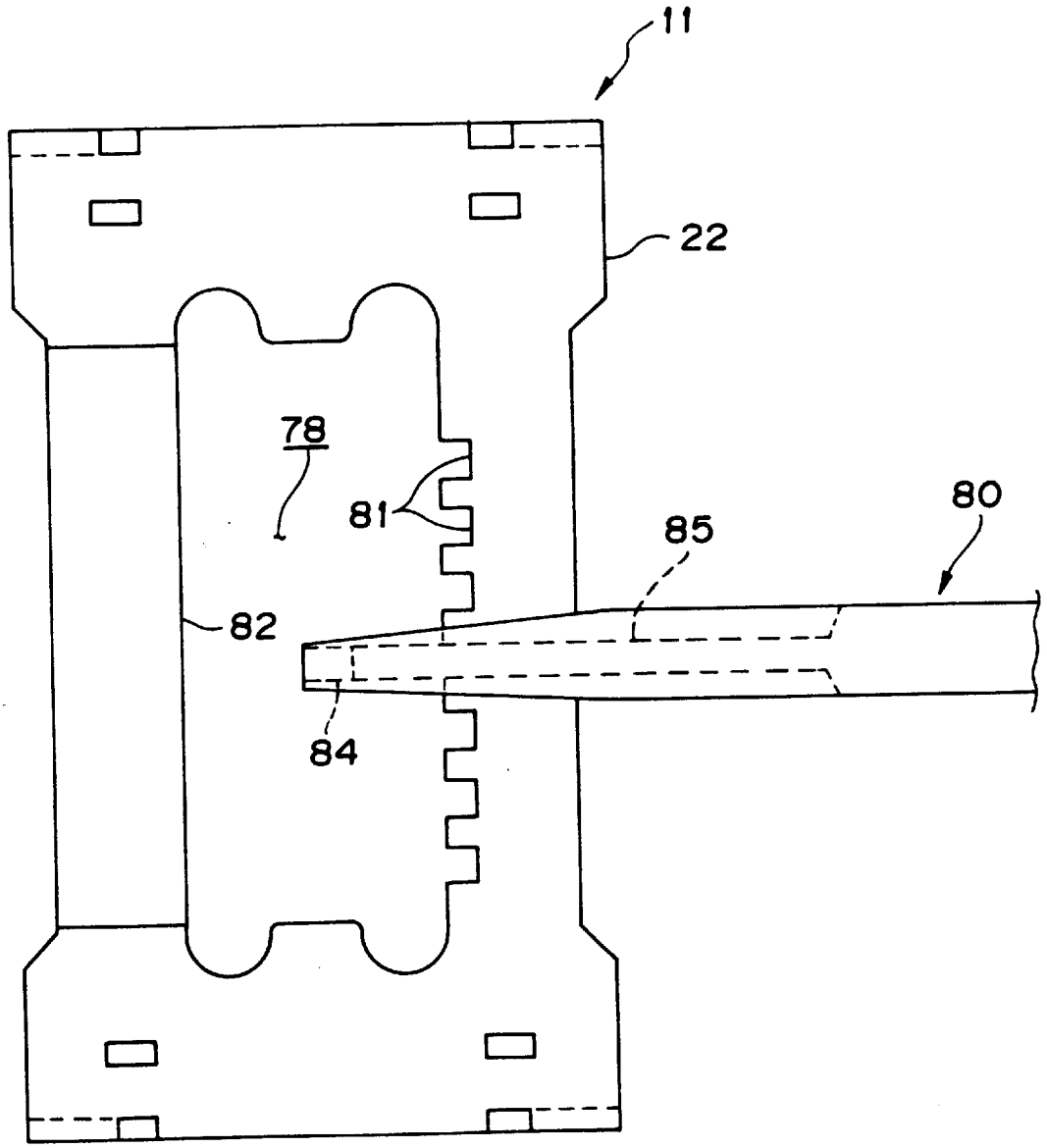
FIG. 17 shows the operation of a printing element shifting bar for feeding the character wheels in the numbering machine in accordance with the present invention.

The printing element 31 of the character wheel unit 12 is fed by using a rectangular printing window 78 formed in the bottom plate 22 of the numbering main body 11 and a printing element shifting bar 80 as shown in FIG. 17.

Formed in the bottom plate 22 of the numbering main body 11 is the rectangular opening. Comb-shaped guide grooves 81 are formed on one side of the printing window 78, and a stopper 82 which can be engaged with the distal end of the printing element shifting bar 80 is provided on the other side thereof. The respective guide grooves 81 are provided in positions corresponding to the respective digits of character wheels 33 of the character wheel unit 12.

Figure 18A:
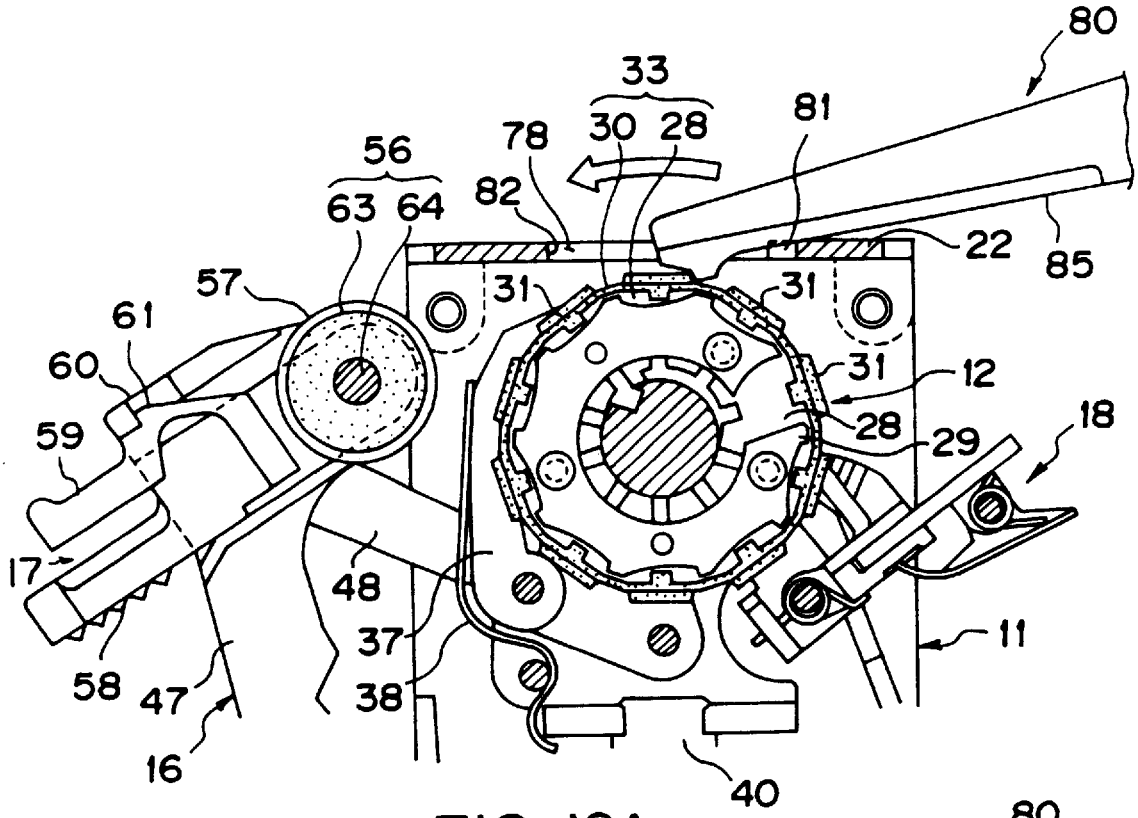
FIG. 18A shows a state immediately before the printing element shifting bar is moved to feed the character wheel.
Figure 18B:
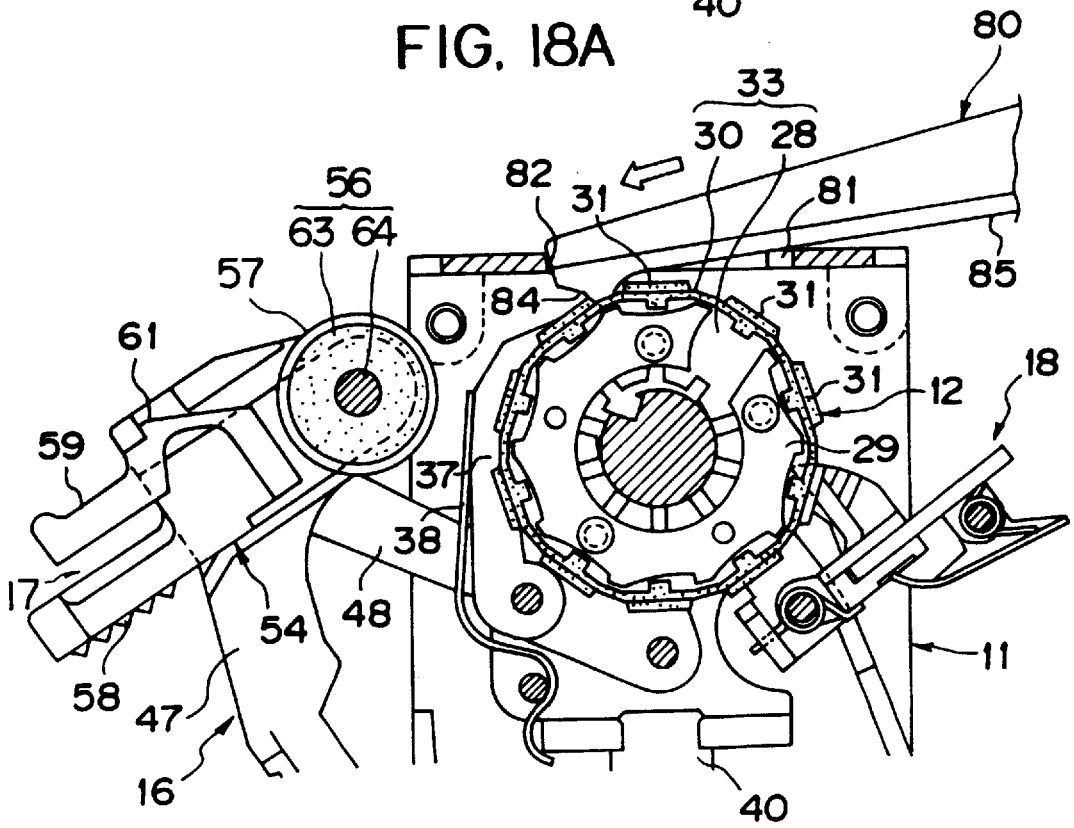
FIG. 18B shows a state wherein the feeding operation has been completed.

As shown in FIGS. 18A and 18B, the printing element shifting bar 80 is a thin long operating bar, the distal end of which is provided with a stepped engaging groove 84 which can be engaged with the side surface of the printing element 31 of the character wheel 33 so as to prevent it from engaging with the printing surface of the printing element, thereby protecting the printing surface. An axial guide projection 85 is formed integrally from the engaging groove 84 of the printing element shifting bar 80 in the lengthwise direction of the printing element shifting bar 80. The guide projection 85 is allowed to selectively and slidably engage with one of the comb-like guide grooves 81 formed on the printing window 78.

In the numbering machine 10, to feed the printing element 31 of the character wheel 33, the operating knob 14 is depressed to move the character wheel unit 12 down to the printing level, and then, the locking lever 44 constituting the locking device is turned to the locking position to render the locked state as shown in FIG. 7. With the operating shaft 40 of the operating means 15 locked by the locking lever 44, the numbering machine 10 is reversed.

After the numbering machine 10 is reversed, the printing element shifting bar 80 is prepared and the engaging groove 84 on the distal end of the shifting bar 80 is pressed against the side surface of the printing element 31 of the required character wheel 33 to engage the guide projection 85 of the printing element shifting bar 80 with the selected guide groove 81. The guide groove 81 is the guide groove located in the position corresponding to the character wheel 33 of the digit to be fed, and it is appropriately selected among the comb-like guide grooves 81.

After the guide projection 85 of the printing element shifting bar 80 is engaged with the selected guide groove 81, the printing element shifting bar 80 is guided by the guide groove 81 and pushed in until the engaging section at the distal end of the shifting bar comes in contact with the stopper 82 formed on the opposite side of the printing window 78. When the distal end of the printing element shifting bar 80 touches the stopper 82, the printing element 31 of the character wheel 33 is fed by one block.

The pushing operation by the printing element shifting bar 80 is repeated until the printing elements 31 of the character wheels 33 of the desired digits have been fed. The same procedure is repeated for feeding the printing elements 31 of the character wheels 33 of the respective digits.

Upon completion of the feed of the printing elements 31 of the respective digits, the locking lever 44 is turned to unlock and it is set in the released position. Setting the locking lever 44 in the released position unlocks the operating shaft 40 which is then reset to the initial position, i.e. home position, by the spring force of the resetting spring 13. This holds the character wheel unit 12 in the home position and sets the numbering machine 10 ready for the subsequent operation.

Another embodiment of the numbering machine in accordance with the present invention will now be described with reference to FIG. 19 and FIG. 20.

In a numbering machine 10A shown in the this embodiment, instead of forming the cam surface on the swinging arm 47 of a swinging arm mechanism 16A, the free end is link-coupled to the connecting link 48 through a cam hole 87 and an engaging pin 88. In the swinging arm mechanism 16A, the engaging pin 88 is provided at the bottom of the swinging arm 47 and the free ends of the connecting links 48 are provided with cam holes 87 shaped like angle brackets or deformed L, and the engaging pin 88 is engaged in the cam holes 87 to construct the cam link mechanism. The rest of the structure of the embodiment is the same as the structure of the first embodiment. Therefore, the same reference numerals are given and the description thereof will be omitted.

In this embodiment also, the swinging arm 47 of the swinging arm mechanism 16A is connected with the free ends of the connecting links 48 through the cam holes 87 and the engaging pin 88 to constitute the cam link mechanism, and by selecting an appropriate shape of the cam holes 87, the down stroke of the character wheel unit 12 is interlocked with the swinging stroke of the ink roller 56 to maintain a nearly constant area of contact of the ink roller 56 which comes in roll-contact with the printing element 31 (strictly speaking, the area of the contact between the ink roller 56 and the printing element 31) all over the surface of the printing element 31.

Figure 21:
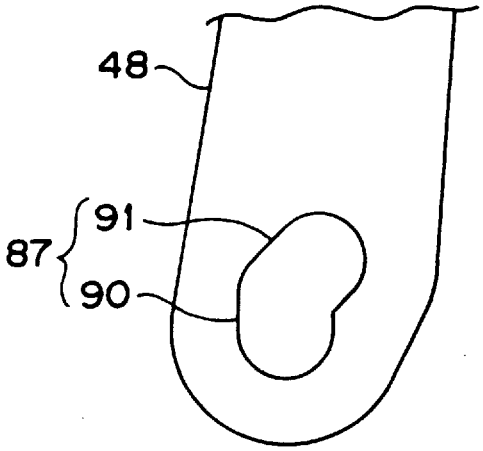
FIG. 21 shows an example of the shape of the cam of a connecting link of a swinging arm mechanism of the numbering machine.

The cam holes of the connecting links 48 are shaped as illustrated in FIG. 21. The cam hole 87 is so designed that a slant hole 91, which tilts outward, follows the top of a slot 90 which extends in the axial direction in FIG. 21. The slant surface, i.e. cam surface, constituting the slant hole 91 provides the cam action which assures the constant area of contact between the ink roller 56 and the printing elements 31 of the respective character wheels 33 all over the printing element surfaces.

The numbering machine 10A assures the uniform contact between the ink roller 56 and the printing elements 31 of the respective character wheels 33 without the need of providing the character wheel unit 12 with the engaging projection or providing the swinging arm 47 with the cam surface.

Figure 19:
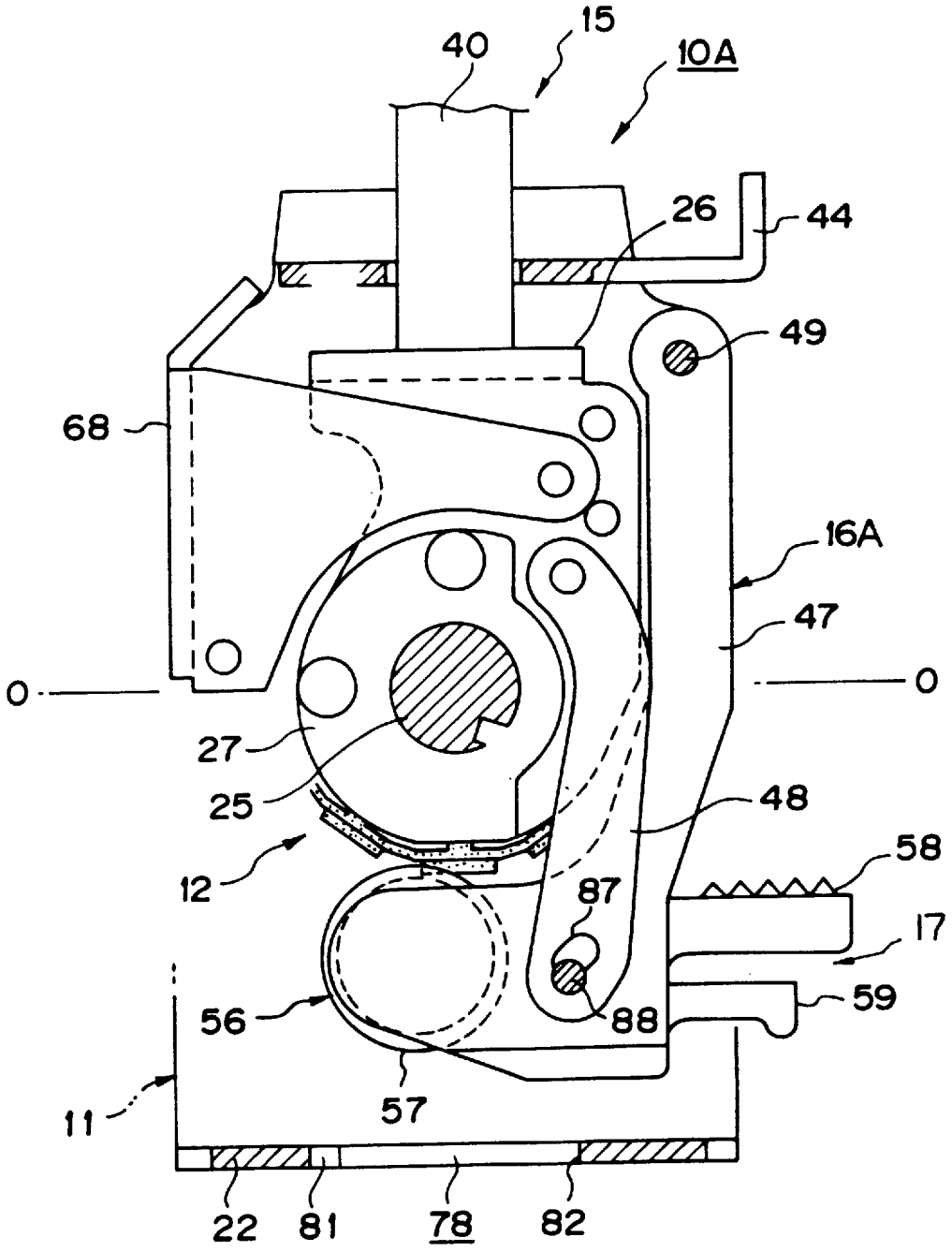
FIG. 19 a schematic diagram showing another embodiment of the numbering machine in accordance with the present invention.
Figure 20:
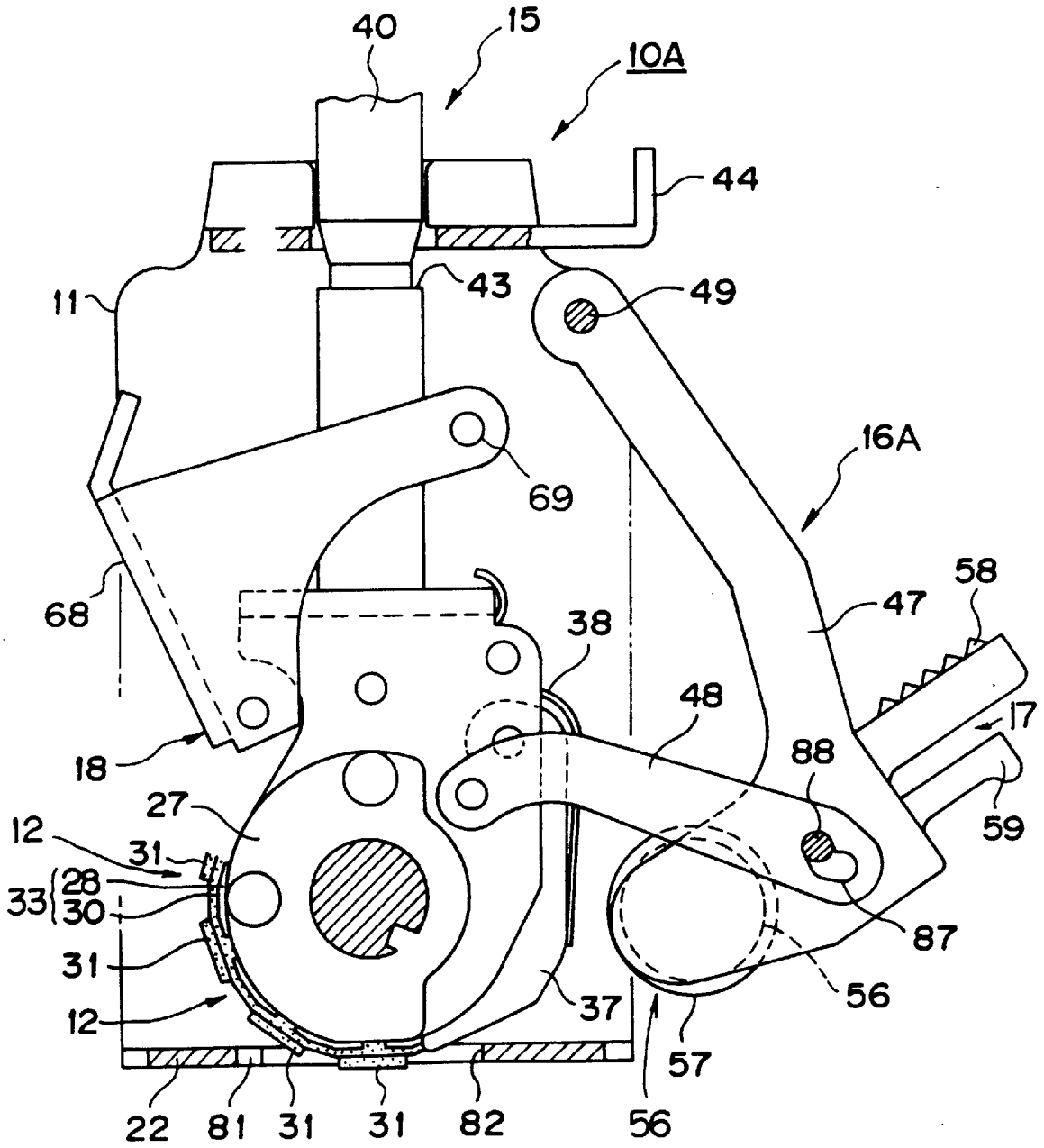
FIG. 20 shows the numbering machine shown in FIG. 19 under printing condition.

The numbering machine 10A shown in FIG. 19 and FIG. 20 shows an example wherein the swinging arm 47 of the swinging arm mechanism 16A has the engaging pin 88 and the connecting links 48 have the cam holes 87. As an alternative, however, the engaging pin 88 may be provided in the connecting links 48 and the cam holes 87 in the swinging arm 47.

As described above, the cassette-type ink roller device in accordance with the present invention has the pair of engaging grooves in the roller holding frame equipped with the operating handle. The engaging grooves enable the ink roller to be easily and quickly detached and attached in a convenient place to replace it.

Further, the guide discs which have a larger diameter than the roller and which are provided on both sides of the ink roller effectively prevent the rolling surface of the ink roller from coming in contact with something around it and soiling it while replacing the ink roller. This feature makes it possible to replace the ink roller without the need of holding the roller, so that the ink roller can be detached and attached efficiently without staining the hands or anything around it.

Furthermore, the ink roller in the ink roller device is comprised of an open-cell elastic sponge roller which is impregnated with ink and which is mounted on a roller shaft. This arrangement enables the sponge roller to hold a large amount of ink. The ink roller is pressed by the printing elements of the character wheels and it rolls and contact them, so that a new roller surface area contacts the printing elements at all times. In addition, the entire roller surface effectively and efficiently contact the printing elements, resulting in a prolonged service life.

In the numbering machine in accordance with the present invention, the numbering main body is provided with the swinging arm mechanism which swings as the operating knob is depressed and the cassette type ink roller device is detachably provided at the bottom of the swinging arm mechanism. Therefore, the ink roller device can be easily and quickly detached or attached. Furthermore, since the ink roller device is detachably mounted on the roller holding frame, the ink roller device can be removed from the numbering machine to replace the ink roller in a convenient place. In the ink roller device, the ink roller is also detachably mounted on the roller holding frame. Therefore, the ink roller can be easily and smoothly detached from or attached to the roller holding frame with a great degree of freedom in an easy-to-work place. Moreover, when the numbering machine is used to print a number, symbol, character, etc. on a document, the ink roller of the ink roller device which is detachably retained at the bottom of the swinging arm mechanism comes in roll-contact with the printing elements of the character wheel unit and new roller surface spots contact the printing surfaces of the printing elements one after another. Hence, the entire surface of the ink roller is efficiently used, resulting in a prolonged service life of the roller.

Further, the cam surface is formed in the middle of the swinging arm of the swinging arm mechanism so that the engaging projection of the character wheel unit can be engaged with the cam surface. With this arrangement, when the character wheel unit moves down and the swinging arm mechanism moves accordingly, the initial operation of the swinging arm mechanism is triggered so as to ensure smooth movement of the swinging arm. Also, at the same time, the movement of the swinging arm is controlled by the locus of the cam surface so that the contacting area of the ink roller which rolls and contacts the printing elements stays nearly constant. This feature makes it possible to maintain a constant contact area of the ink roller (strictly speaking, the area of contact between the ink roller and the printing elements) all over the surfaces of the printing elements, thus assuring uniform application of ink to the printing elements.

Regarding the swinging arm mechanism, instead of providing the swinging arm with the cam surface, the swinging arm and the free end of the connecting link are linked using the engaging pin and the cam hole of the required shape. This also makes it possible to maintain the constant contact area of the ink roller all over the printing elements, thus assuring uniform and stable application of ink to the printing elements.

In addition, the numbering machine in accordance with the present invention has a comb-shaped guide grooves on one side of the printing window formed in the bottom plate of the numbering main body and the stopper which can be engaged with the printing element shifting bar. Hence, with the distal end of the printing element shifting bar engaged with the printing element of the character wheel, the axial guide projection of the printing element shifting bar can be slid by engaging it with the guide groove which has been selected among the comb-like guide grooves. This provides an advantage in that the printing element of the character wheel can be easily fed by one digit at a time and the feeding control, i.e. the section of a character, etc., of the character wheels of the respective digits can be achieved easily and quickly.

What is claimed is:

1. An ink roller device of cassette-type adapted to a numbering machine, comprising:

a roller holding frame made of an elastic material and provided with an operating handle, said roller holding frame being formed with a pair of engaging grooves each having substantially a V-shape opening in a direction substantially normal to a longitudinal direction of the roller holding frame;

an ink roller having a roller shaft which is detachably and rotatably held in the engaging grooves;

guide discs which are installed on both longitudinal side ends of said ink roller and each of which has a larger diameter than that of the roller; and an elastic retaining section formed integrally with the operating handle of the roller holding frame to be operated by the operation of the operating handle and to be fixed to an element of the numbering machine.

2. An ink roller device according to claim 1, wherein said ink roller is an open-cell elastic sponge roller which is impregnated with ink and which is mounted on a roller shaft.

3. An ink roller device according to claim 1, wherein each of the engaging grooves having a V-shaped structure has a circular portion at a bottom portion of the V-shaped structure into which the roller shaft is press fitted.

4. A numbering machine comprising:

a numbering main body having a frame structure;

a character wheel unit having character wheels for respective digits and an engaging projection and which is incorporated in said main body so that it is allowed to move up and down between a printing position and a home position thereof;

operating means equipped with an operating knob and a resetting spring disposed therein and which is capable of depressing said character wheel unit against the spring force of said resetting spring;

a swinging arm mechanism which is provided on said numbering main body and swings when the operating knob is depressed; and a cassette-type ink roller device which is detachably held at a bottom of said swinging arm mechanism, including, a roller holding frame made of an elastic material and provided with an operating handle, said roller holding frame being formed with a pair of engaging grooves each having substantially a V-shaped opening in a direction substantially normal to a longitudinal direction of the roller holding frame, an ink roller having a roller shaft which is detachably and rotatably held in the engaging grooves, guide discs which are installed on both longitudinal side ends of said ink roller and each of which has a larger diameter than that of the roller, and an elastic retaining section formed integrally with the operating handle of the roller holding frame to be operated by the operation of the operating handle so as to engage said swinging arm mechanism.

5. A numbering machine according to claim 4, further comprising:

a horizontal supporting shaft at a top portion of said numbering main body; and printing elements having a printing surface and respectively disposed on said character wheels for respective digits;

wherein said swinging arm mechanism comprises a swinging arm which is supported so that it is allowed to swing around the horizontal supporting shaft, said swinging arm having a slant cam surface in a middle portion thereof so that the engaging projection of the character wheel unit comes in contact with said slant cam surface, said slant cam surface of said swinging arm triggering an initial operation of said swinging arm mechanism, and said slant cam surface having a locus designed so that a contact area of said ink roller which rolls as the roller comes in contact with said printing surfaces of said printing elements is approximately constant.

6. A numbering machine according to claim 4, further comprising:

printing elements having a printing surface and respectively disposed on said character wheels for respective digits;

a horizontal supporting shaft at a top portion of said numbering main body; and wherein said swinging arm mechanism comprises a swinging arm supported so that it is allowed to swing around the horizontal supporting shaft and a connecting link supported by said character wheel unit, said swinging arm and a free end of said connecting link are connected between an engaging pin, said connecting link and a cam hole in one of the swinging arm and connecting link constitute a cam link mechanism, said cam link mechanism triggering an initial operation of said swinging arm mechanism, and said cam hole has a shape formed to ensure an approximately constant contact area of said ink roller which rolls as the roller comes in contact with the printing surfaces of said printing elements.

7. A numbering machine according to claim 4, further comprising:

a printing element shifting bar disposed near the numbering main body and having a guide projection formed integrally thereon; and wherein comb-shaped guide grooves are formed on one side of a printing window formed in a bottom plate of said numbering main body so that said guide grooves face against the character wheels for the respective digits of said character wheel unit, the other side of said printing window is formed into a stopper so as to engage with a distal end of the printing element shifting bar, and the guide projection in the axial direction of said printing element shifting bar is slidably engaged in said guide grooves.

8. A numbering machine comprising:

a numbering main body having a frame structure and a top portion;

a character wheel unit including printing elements having a printing surface and which is incorporated in the main body so that it is allowed to move up and down between a printing position and a home position thereof;

operating means equipped with an operating knob and a resetting spring disposed therein and which is capable of depressing said character wheel unit against the spring force of said resetting spring;

a swinging arm mechanism which is provided on said numbering main body and swings when the operating knob is depressed;

a horizontal supporting shaft at the top portion of said numbering main body; and a cassette-type ink roller device which is detachably held at a bottom of said swinging arm mechanism, said ink roller device having an ink roller which is detachably mounted on said roller holding frame;

wherein said swinging arm mechanism comprises a swinging arm having a middle portion and which is supported so that it is allowed to swing around said horizontal supporting shaft, said swinging arm having a slant cam surface in said middle portion so that an engaging projection of the character wheel unit comes in contact with said slant cam surface, said slant cam surface of said swinging arm triggering an initial operation of said swinging arm mechanism, and said slant cam surface having a locus designed so that a contact area of said ink roller which rolls as the roller comes in contact with the printing surfaces of said printing elements is approximately constant.

* * * * *